US006916751B1

(12) United States Patent
Kronzer

(10) Patent No.: US 6,916,751 B1
(45) Date of Patent: Jul. 12, 2005

(54) HEAT TRANSFER MATERIAL HAVING MELTABLE LAYERS SEPARATED BY A RELEASE COATING LAYER

(75) Inventor: Francis J. Kronzer, Woodstock, GA (US)

(73) Assignee: Neenah Paper, Inc., Alpharetta, GA (US)

( * ) Notice: Subject to any disclaimer, the term of this patent is extended or adjusted under 35 U.S.C. 154(b) by 185 days.

(21) Appl. No.: 09/614,829

(22) Filed: Jul. 12, 2000

Related U.S. Application Data

(60) Provisional application No. 60/143,353, filed on Jul. 12, 1999.

(51) Int. Cl.[7] ..... D04H 1/00; D04H 13/00; D04H 3/00; D04H 5/00

(52) U.S. Cl. ..... 442/327; 442/381; 442/394; 428/41.8; 428/346; 428/349; 428/352; 428/354

(58) Field of Search ..... 442/327, 381, 442/394; 428/41.8, 346, 349, 352, 354

(56) References Cited

U.S. PATENT DOCUMENTS

| | | | |
|---|---|---|---|
| 1,858,673 | A | 5/1929 | Lawrence |
| 3,359,127 | A | 12/1967 | Meyer et al. |
| 3,616,176 | A | 10/1971 | Jachimowicz |
| 3,790,439 | A | 2/1974 | LaPerre et al. |
| 3,872,040 | A | 3/1975 | Mollohan et al. |
| 3,922,435 | A | 11/1975 | Asnes |
| 4,021,591 | A | 5/1977 | DeVries et al. |
| 4,107,365 | A | 8/1978 | Reed et al. |

(Continued)

FOREIGN PATENT DOCUMENTS

| | | | |
|---|---|---|---|
| EP | 0466503 | A1 | 1/1992 |
| EP | 0652114 | B1 | 5/1995 |
| EP | 0842786 | A1 | 5/1998 |
| EP | 0850786 | B1 | 7/1998 |
| EP | 1020299 | B1 | 7/2000 |
| EP | 1219460 | A2 | 7/2002 |
| EP | 1316435 | A1 | 6/2003 |
| EP | 1340626 | A1 | 9/2003 |
| EP | 1344653 | A1 | 9/2003 |
| EP | 0933226 | B1 | 3/2004 |

(Continued)

OTHER PUBLICATIONS

Kronzer, U.S. Appl. No. 10/749,687, filed Dec. 31, 2003, Matched Heat Transfer Materials And Methods Of Use Thereof.
Konzer, U.S. Appl. No. 10/750,387, filed Dec. 31, 2003, Heat Transfer Material.
Kronzer, U.S. Appl. No. 10/894,841, Jul. 20, 2004, Heat Transfer Materials And Method Of Use Thereof.

*Primary Examiner*—Elizabeth M. Cole
*Assistant Examiner*—Norca L. Torres
(74) *Attorney, Agent, or Firm*—Dority & Manning, P.A.

(57) ABSTRACT

The present invention is directed to a heat transfer material containing a first (interior) meltable layer, a second (surface) meltable layer, and a release coating layer separating the first and second meltable layers. During a transfer process, the first (interior) meltable layer, release coating layer, and second (surface) meltable layer penetrate into the yarn interstices, or other undulations, of a given substrate to be coated. Only the second (surface) meltable layer transfers to the substrate, resulting in a thinner transfer coating compared to conventional coatings.

The present invention is also directed to a method of making a printable heat transfer material and a method of forming an image-bearing coating on a surface of a substrate using the printable heat transfer material in a hot or cold peelable transfer process.

20 Claims, 1 Drawing Sheet

U.S. PATENT DOCUMENTS

| | | | | | |
|---|---|---|---|---|---|
| 4,167,414 | A | | 9/1979 | Morgan | |
| 4,224,358 | A | | 9/1980 | Hare | |
| 4,235,657 | A | | 11/1980 | Greenman | |
| 4,240,807 | A | | 12/1980 | Kronzer | |
| 4,303,717 | A | | 12/1981 | Andrews | |
| 4,322,467 | A | | 3/1982 | Heimbach et al. | |
| 4,351,871 | A | | 9/1982 | Lewis et al. | |
| 4,383,878 | A | | 5/1983 | Young et al. | |
| 4,399,209 | A | | 8/1983 | Sanders et al. | |
| 4,496,618 | A | | 1/1985 | Pernicano | |
| 4,517,237 | A | | 5/1985 | Pernicano | |
| 4,536,434 | A | | 8/1985 | Magnotta | |
| 4,548,857 | A | | 10/1985 | Galante | |
| 4,664,735 | A | | 5/1987 | Pernicano | |
| 4,757,047 | A | | 7/1988 | Kosaka | |
| 4,758,952 | A | | 7/1988 | Harris, Jr. et al. | |
| 4,773,953 | A | | 9/1988 | Hare | |
| 4,775,657 | A | | 10/1988 | Harrison et al. | |
| 4,786,349 | A | | 11/1988 | Mahn, Sr. | |
| 4,863,781 | A | | 9/1989 | Kronzer | |
| 4,929,501 | A | | 5/1990 | Okada et al. | |
| 4,966,815 | A | | 10/1990 | Hare | |
| 4,980,224 | A | | 12/1990 | Hare | |
| 5,006,502 | A | | 4/1991 | Fujimura et al. | |
| 5,019,475 | A | | 5/1991 | Higashiyama et al. | |
| 5,028,028 | A | | 7/1991 | Yamada et al. | |
| 5,053,267 | A | | 10/1991 | Ide et al. | |
| 5,059,580 | A | | 10/1991 | Shibata et al. | |
| 5,064,743 | A | | 11/1991 | Koshizuka et al. | |
| 5,087,527 | A | | 2/1992 | Shimura et al. | |
| 5,110,389 | A | | 5/1992 | Hiyoshi et al. | |
| 5,132,277 | A | | 7/1992 | Kaszczuk et al. | |
| 5,139,917 | A | | 8/1992 | Hare | |
| 5,141,915 | A | | 8/1992 | Roenigk et al. | |
| 5,151,326 | A | | 9/1992 | Matsuda et al. | |
| 5,236,801 | A | | 8/1993 | Hare | |
| 5,242,739 | A | | 9/1993 | Kronzer et al. | |
| 5,248,543 | A | | 9/1993 | Yamaguchi et al. | |
| 5,252,531 | A | | 10/1993 | Yasuda et al. | |
| 5,252,533 | A | | 10/1993 | Yasuda et al. | |
| 5,263,781 | A | | 11/1993 | Mima et al. | |
| 5,264,279 | A | | 11/1993 | Imamura et al. | |
| 5,271,990 | A | | 12/1993 | Kronzer et al. | |
| 5,286,521 | A | | 2/1994 | Matsuda et al. | |
| 5,310,589 | A | | 5/1994 | Nagashima | |
| 5,318,943 | A | | 6/1994 | Ueno et al. | |
| 5,332,713 | A | | 7/1994 | Oldfield et al. | |
| 5,334,439 | A | | 8/1994 | Kawaguchi et al. | |
| 5,338,603 | A | | 8/1994 | Mahn, Sr. et al. | |
| 5,342,739 | A | | 8/1994 | Katou et al. | |
| 5,356,853 | A | | 10/1994 | Ueno et al. | |
| 5,362,703 | A | | 11/1994 | Kawasaki et al. | |
| 5,366,251 | A | | 11/1994 | Brandt et al. | |
| 5,372,987 | A | | 12/1994 | Fisch et al. | |
| 5,372,988 | A | | 12/1994 | Takeuchi et al. | |
| 5,387,574 | A | | 2/1995 | Campbell et al. | |
| 5,407,724 | A | | 4/1995 | Mimura et al. | |
| 5,413,841 | A | | 5/1995 | Mahn, Sr. et al. | |
| 5,419,944 | A | | 5/1995 | Sammis | |
| 5,427,997 | A | * | 6/1995 | Oshima et al. | 503/227 |
| 5,431,501 | A | | 7/1995 | Hale et al. | |
| 5,432,258 | A | | 7/1995 | Yoshimura | |
| 5,444,037 | A | | 8/1995 | Imai et al. | |
| 5,484,644 | A | | 1/1996 | Imamura et al. | |
| 5,501,902 | A | | 3/1996 | Kronzer | 428/323 |
| 5,508,105 | A | | 4/1996 | Orensteen et al. | |
| 5,571,766 | A | | 11/1996 | Imai et al. | |
| 5,614,345 | A | | 3/1997 | Gumbiowski et al. | |
| 5,616,155 | A | | 4/1997 | Kronzer | |
| 5,647,935 | A | | 7/1997 | Hoshino et al. | |
| 5,654,080 | A | | 8/1997 | Hayashi et al. | |
| 5,660,928 | A | | 8/1997 | Stokes et al. | |
| 5,670,448 | A | | 9/1997 | Kometani | 503/227 |
| 5,677,049 | A | | 10/1997 | Torii | |
| 5,707,925 | A | | 1/1998 | Akada et al. | |
| 5,716,477 | A | | 2/1998 | Yamaguchi et al. | |
| 5,716,900 | A | | 2/1998 | Kronzer et al. | |
| 5,770,268 | A | | 6/1998 | Kuo et al. | |
| 5,776,854 | A | | 7/1998 | Hayashi | |
| 5,798,161 | A | | 8/1998 | Kita et al. | |
| 5,798,179 | A | * | 8/1998 | Kronzer | 428/411.1 |
| 5,846,367 | A | | 12/1998 | Omote et al. | |
| 5,861,355 | A | | 1/1999 | Olson et al. | |
| 5,876,836 | A | | 3/1999 | Imamura et al. | |
| 5,879,813 | A | | 3/1999 | Tanaka et al. | |
| 5,880,065 | A | | 3/1999 | Hayashi et al. | |
| 5,885,928 | A | | 3/1999 | Hirano et al. | |
| 5,891,824 | A | | 4/1999 | Simpson et al. | |
| 5,895,557 | A | | 4/1999 | Kronzer | |
| 5,897,735 | A | | 4/1999 | Peskin | |
| 5,898,018 | A | | 4/1999 | Hirano et al. | |
| 5,925,712 | A | | 7/1999 | Kronzer | |
| 5,942,335 | A | | 8/1999 | Chen et al. | |
| 5,945,375 | A | | 8/1999 | Kronzer | |
| 5,948,586 | A | | 9/1999 | Hare | |
| 5,962,149 | A | | 10/1999 | Kronzer | |
| 5,981,045 | A | | 11/1999 | Kuwabara et al. | |
| 5,981,077 | A | | 11/1999 | Taniguchi | |
| 6,017,636 | A | | 1/2000 | Tada et al. | |
| 6,020,397 | A | | 2/2000 | Matzinger | |
| 6,033,739 | A | | 3/2000 | Kronzer | |
| 6,043,194 | A | | 3/2000 | Saito et al. | |
| 6,054,223 | A | | 4/2000 | Tsuchiya et al. | |
| 6,066,387 | A | | 5/2000 | Ueda et al. | |
| 6,071,368 | A | | 6/2000 | Boyd et al. | |
| 6,083,656 | A | | 7/2000 | Hare et al. | |
| 6,083,872 | A | | 7/2000 | Adkins | |
| 6,087,061 | A | | 7/2000 | Hare et al. | |
| 6,096,475 | A | | 8/2000 | Hare et al. | |
| 6,103,364 | A | | 8/2000 | Harris et al. | |
| 6,113,725 | A | | 9/2000 | Kronzer | |
| 6,139,672 | A | | 10/2000 | Sato et al. | |
| 6,177,187 | B1 | | 1/2001 | Niemoller et al. | |
| 6,180,219 | B1 | | 1/2001 | Hoshino et al. | |
| 6,200,668 | B1 | * | 3/2001 | Kronzer | 428/32.77 |
| 6,210,794 | B1 | | 4/2001 | Nakamura | |
| 6,214,149 | B1 | | 4/2001 | Nakano et al. | |
| 6,232,267 | B1 | | 5/2001 | Oshima et al. | |
| 6,232,268 | B1 | | 5/2001 | Narita et al. | |
| 6,245,710 | B1 | | 6/2001 | Hare et al. | |
| 6,251,824 | B1 | | 6/2001 | Ueno et al. | |
| 6,265,053 | B1 | | 7/2001 | Kronzer et al. | |
| 6,277,229 | B1 | | 8/2001 | Popat et al. | |
| 6,281,166 | B1 | | 8/2001 | Kronzer | |
| 6,290,798 | B1 | | 9/2001 | Onishi et al. | |
| 6,294,307 | B1 | | 9/2001 | Hare et al. | |
| 6,335,307 | B1 | | 1/2002 | Imai et al. | |
| 6,346,313 | B1 | | 2/2002 | Cook | |
| 6,358,600 | B1 | | 3/2002 | Hayashi et al. | |
| 6,358,660 | B1 | * | 3/2002 | Agler et al. | 430/126 |
| 6,383,710 | B2 | | 5/2002 | Hare et al. | |
| 6,395,375 | B1 | | 5/2002 | Imamura et al. | |
| 6,410,200 | B1 | * | 6/2002 | Williams et al. | 430/126 |
| 6,423,466 | B2 | | 7/2002 | Hare et al. | |
| 6,428,878 | B1 | | 8/2002 | Kronzer | |
| 6,432,549 | B1 | | 8/2002 | Kronzer | |
| 6,450,633 | B1 | | 9/2002 | Kronzer | |
| 6,465,393 | B1 | | 10/2002 | Nakano et al. | |
| 6,482,285 | B2 | | 11/2002 | Cross | |
| 6,497,781 | B1 | | 12/2002 | Dalvey et al. | |
| 6,509,131 | B2 | | 1/2003 | Hare et al. | |

| | | | |
|---|---|---|---|
| 6,531,216 | B1 | 3/2003 | Williams et al. |
| 6,551,692 | B1 | 4/2003 | Dalvey et al. |
| 6,582,803 | B2 | 6/2003 | Cole et al. |
| 6,593,406 | B2 | 7/2003 | Sargeant et al. |
| 6,613,412 | B1 | 9/2003 | Dressler |
| 6,737,152 | B2 | 5/2004 | Suzuki et al. |
| 2002/0081420 | A1 | 6/2002 | Kronzer |
| 2002/0146544 | A1 | 10/2002 | Kronzer |
| 2002/0153110 | A1 | 10/2002 | Yamaguchi et al. |
| 2003/0008116 | A1 | 1/2003 | Williams et al. |

FOREIGN PATENT DOCUMENTS

| | | | |
|---|---|---|---|
| FR | 2442721 | | 6/1980 |
| GB | 1487599 | | 10/1977 |
| GB | 2084931 | A | 4/1982 |
| GB | 2147614 | A | 5/1985 |
| GB | 2 243 332 | A | 10/1991 |
| JP | 1208192 | | 8/1989 |
| JP | 3010879 | | 1/1991 |
| JP | 6155995 | | 6/1994 |
| JP | 6312573 | | 11/1994 |
| JP | 200377652 | | 10/2003 |
| WO | WO 8704393 | A1 | 7/1987 |
| WO | WO 9000473 | A1 | 1/1990 |
| WO | WO 9000473 | A1 | 1/1990 |
| WO | WO 91/06433 | | 5/1991 |
| WO | WO 9106433 | A1 | 5/1991 |
| WO | WO 9222857 | A1 | 12/1992 |
| WO | WO 9321561 | A1 | 10/1993 |
| WO | WO 9508419 | A1 | 3/1995 |
| WO | WO 9610491 | A1 | 4/1996 |
| WO | WO 9701448 | A1 | 1/1997 |
| WO | WO 9733763 | A2 | 9/1997 |
| WO | WO 9733763 | A3 | 9/1997 |
| WO | WO 9925917 | A1 | 5/1999 |
| WO | WO 0059733 | A1 | 10/2000 |
| WO | WO 0064685 | A1 | 11/2000 |
| WO | WO 0073570 | A1 | 12/2000 |
| WO | WO 0103941 | A1 | 1/2001 |
| WO | WO 0112448 | A1 | 2/2001 |
| WO | WO 0117792 | A1 | 3/2001 |
| WO | WO 0123664 | A1 | 4/2001 |
| WO | WO 0162514 | A2 | 8/2001 |
| WO | WO 0162514 | A3 | 8/2001 |
| WO | WO 0236353 | A2 | 5/2002 |
| WO | WO 0236353 | A3 | 5/2002 |
| WO | WO 02055311 | A3 | 7/2002 |
| WO | WO 02055311 | A2 | 7/2002 |
| WO | WO 03006736 | A1 | 1/2003 |

* cited by examiner

HEAT TRANSFER MATERIAL HAVING MELTABLE LAYERS SEPARATED BY A RELEASE COATING LAYER

This application claims the benefit of Provisional application Ser. No. 60/143,353, filed Jul. 12, 1999.

TECHNICAL FIELD

The present invention is directed to heat transfer materials, methods of making heat transfer materials, and methods of transfer coating using heat transfer materials.

BACKGROUND OF THE INVENTION

In recent years, a significant industry has developed which involves the application of customer-selected designs, messages, illustrations, and the like (referred to collectively hereinafter as "customer-selected graphics") on articles of clothing, such as T-shirts, sweat shirts, and the like. These customer-selected graphics typically are commercially available products tailored for a specific end-use and are printed on a release or transfer paper. The graphics are transferred to the article of clothing by means of heat and pressure, after which the release or transfer paper is removed.

Heat transfer papers having an enhanced receptivity for images made by wax-based crayons, thermal printer ribbons, and impact ribbon or dot-matrix printers, are well known in the art. Typically, a heat transfer sheet comprises a cellulosic base sheet and an image-receptive coating on a surface of the base sheet. The image-receptive coating usually contains one or more film-forming polymeric binders, as well as, other additives to improve the transferability and printability of the coating. Other heat transfer sheets comprise a cellulosic base sheet and an image-receptive coating, wherein the image-receptive coating is formed by melt extrusion or by laminating a film to the base sheet. The surface of the coating or film may then be roughened by, for example, passing the coated base sheet through an embossing roll.

Much effort has been directed at generally improving the transferability of an image-bearing laminate (coating) to a substrate. For example, an improved cold-peelable heat transfer material has been described in U.S. Pat. No. 5,798,179, which allows removal of the base sheet immediately after transfer of the image-bearing laminate ("hot peelable heat transfer material") or some time thereafter when the laminate has cooled ("cold peelable heat transfer material"). Moreover, additional effort has been directed to improving the crack resistance and washability of the transferred laminate. The transferred laminate must be able to withstand multiple wash cycles and normal "wear and tear" without cracking or fading.

Various techniques have been used in an attempt to improve the overall quality of the transferred laminate and the article of clothing containing the same. For example, plasticizers and coating additives have been added to coatings of heat transfer materials to improve the crack resistance and washability of image-bearing laminates on articles of clothing. However, cracking and fading of the transferred image-bearing coating continues to be a problem in the art of heat transfer coatings.

Conventional heat transfer materials result in less than desirable finished products due to the relatively large thickness of the transfer coating. In conventional "hot peel" heat transfer processes, a relatively thick transfer coating layer is required to avoid quality problems, such as splitting of the transfer coating while the base sheet is removed. In conventional "cold peel" heat transfer processes, all of the transfer coating is released from the base sheet, forming a relatively thick coating. Typically, in these processes the transfer coating thickness is at least 40 grams per square meter (gsm). The relatively thick coatings fill the gaps within and between adjacent yarns of the coated fabric, forming bridges over the yarn gaps. The bridges tend to crack when the fabric is washed, resulting in a very poor appearance. Furthermore, the thick transfer coating tends to become sticky when exposed to hot air, such as found in a clothes dryer, such that garments stick together if dried in a hot clothes dryer.

In addition to the problems of cracking and fading of the transferred image-bearing coating, the breathability of the coated article of clothing continues to be a problem using conventional heat transfer coatings. Conventional heat transfer coatings, whether applied using a hot-peelable heat transfer material or a cold-peelable heat transfer material, require a minimal coating thickness in order to produce a continuous image-bearing coating. This results in a finished article of clothing having negligible breathability.

What is needed in the art is a heat transfer material, which substantially resists cracking while maintaining or enhancing the breathability of the coating. What is also needed in the art is a heat transfer material having a heat fusible coating thereon, wherein the heat fusible coating enables the production of a finished, image-bearing, article of clothing having breathability.

SUMMARY OF THE INVENTION

The present invention addresses some of the difficulties and problems discussed above by the discovery of a heat transfer material having a unique structure, which enables the transfer of a continuous, image-bearing coating onto an article of clothing, wherein the transfer coating thickness is less than conventional transfer coatings. The heat transfer material of the present invention may be applied, using a hot or cold peelable method, without the processability and quality problems associated with conventional heat transfer materials.

The heat transfer material of the present invention contains an interior meltable layer, a surface meltable layer, and a release coating layer. The release coating layer separates the two meltable layers. During application with heat and pressure, the interior meltable layer, release coating layer, and surface meltable layer penetrate into the yarn interstices, or other undulations, of a given substrate to be coated. However, only the surface meltable layer transfers to the substrate. The resulting transfer coating has a coating thickness less than conventional coatings, which provides improved breathability of the coated substrate.

The present invention is also directed to a method of making a printable heat transfer material having the above described structure. The method includes the steps of applying a release coating to an interior meltable layer and applying a surface meltable layer to the release coating layer.

The present invention is further directed to a method of transfer coating using the above described printable heat transfer material. The method includes the steps of applying heat and pressure to the heat transfer material and removing the interior meltable layer and release layer from the coated substrate.

These and other features and advantages of the present invention will become apparent after a review of the following detailed description of the disclosed embodiments and the appended claims.

DETAILED DESCRIPTION OF THE INVENTION

The present invention is directed to a unique heat transfer material for use in transferring an image-bearing coating onto a substrate, such as an article of clothing. The heat transfer material of the present invention may be used in both hot and cold peel transfer processes, resulting in an image-bearing coating having superior crack resistance, washability, and breathability compared to conventional image-bearing coatings. The heat transfer material of the present invention produces superior results due to its unique multi-layer structure.

The heat transfer material of the present invention comprises at least two meltable layers separated by a release coating layer. The first meltable layer, designated an interior meltable layer (or base coating), along with the release layer, provide a "penetrating effect" to the heat transfer sheet, which forces the second meltable layer, designated the surface meltable layer (or print coating), into the interstices of a given substrate to be coated, such as a T-shirt. In addition to the layers above, the heat transfer material of the present invention may include one or more of the following layers: a base substrate, a sub-coating layer, and a top coating layer. Each of the individual layers of the heat transfer material, when present, provides a desirable property to the overall heat transfer sheet.

Figure 1:
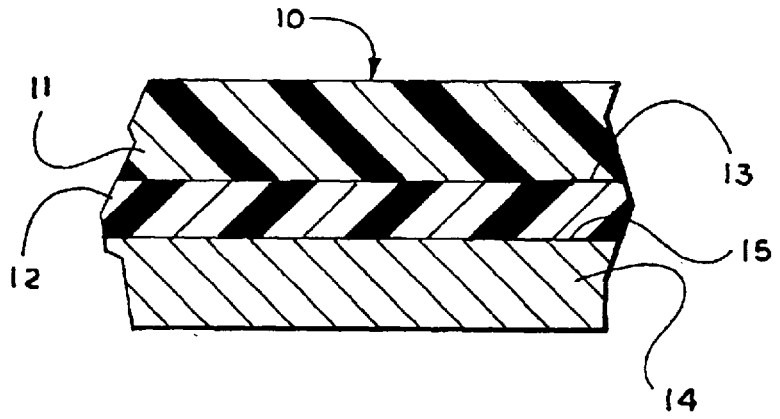
FIG. 1 is a fragmentary sectional view of a first embodiment of a printable heat transfer material of the present invention.
Figure 2:
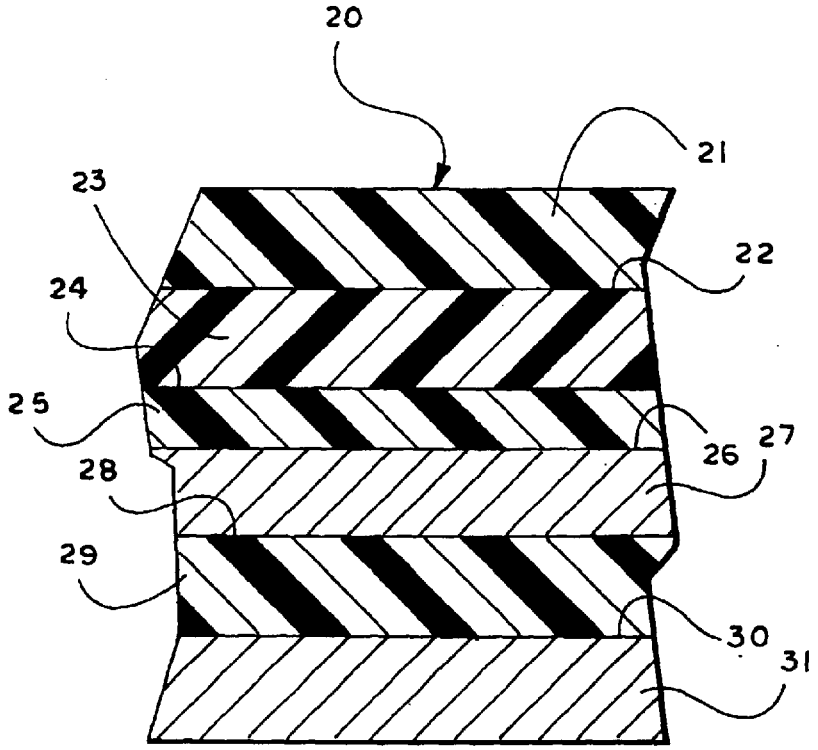
FIG. 2 is a fragmentary sectional view of a second embodiment of a printable heat transfer material of the present invention.

The heat transfer material of the present invention may comprise various layers as discussed above. In one embodiment of the present invention, shown in FIG. 1, the heat transfer material 10 comprises a first meltable layer (interior meltable layer) 11; a release layer 12, provided on a surface 13 of first meltable layer 11; and a second meltable layer (surface meltable layer or print layer) 14, provided on a surface 15 of release layer 12. In a further embodiment of the present invention, shown in FIG. 2, the heat transfer material 20 comprises a base layer 21; a first meltable layer (interior meltable layer) 23, provided on a surface 22 of base layer 21; a release layer 25, provided on a surface 24 of first meltable layer 23; a sub-coating layer 27, provided on a surface 26 of release layer 25; a second meltable layer (surface meltable layer) 29, provided on a surface 28 of sub-coating layer 27; and a top coating layer 31, provided on a surface 30 of second meltable layer 29. Each of the above-mentioned individual layers of the heat transfer materials of the present invention are described below.

The interior meltable layer of the heat transfer material of the present invention may comprise any material capable of melting and conforming to the surface of a substrate to be coated. Desirably, the interior meltable layer has a melt flow index of less than about 500 and a melting temperature and/or a softening temperature of less than about 400° F. As used herein, "melting temperature" and "softening temperature" are used to refer to the temperature at which the meltable layer melts and/or flows under conditions of shear. More desirably, the interior meltable layer has a melt flow index of from about 0.5 to about 100, and a softening temperature of from about 150° F. to about 300° F. Even more desirably, the interior meltable layer has a melt flow index of from about 2 to about 50, and a softening temperature of from about 200° F. to about 250° F.

Since the interior meltable layer is not transferred to the coated substrate, the composition and thickness of the interior meltable layer may vary considerably, as long as the layer is meltable and conformable. The interior meltable layer may comprise one or more thermoplastic polymers including, but not limited to, polyolefins and ethylene-containing homopolymers and copolymers. In addition to the thermoplastic polymer(s), other materials may be added to the interior meltable layer to provide improved melt flow properties, such as plasticizers in solid or liquid form. Further, other materials may be added to improve the coating characteristics in liquid carriers including, but not limited to, surfactants and viscosity modifiers. Desirably, the interior meltable layer comprises up to about 5 wt % of one or more additives, based on the total weight of the dry interior meltable layer. Suitable surfactants include, but are not limited to, an ethoxylated alcohol surfactant available from Union Carbide (Danbury, Conn.) under the tradename TERGITOL® 15-S40, and a nonionic surfactant available from Union Carbide under the tradename TRITON® X100. Suitable viscosity modifiers include, but are not limited to, polyethylene oxide available from Union Carbide under the tradename POLYOX® N60K and methylcellulose.

In an alternative embodiment of the present invention, the interior meltable layer may be in the form of a melt-extruded film. The extruded film may comprise one or more of the above-described materials having the desired meltability and conformability properties. In one embodiment of the present invention, the interior meltable layer comprises an extruded film of ELVAX® 3200, a wax modified ethylene-vinyl acetate copolymer having a melt index of 30 available from DuPont (Wilmington, Del.); an extruded film of ENGAGE® 8200, a metallocene catalyzed, highly branched polyethylene having a melt index of 5 available from Dow Chemical Company (Midland, Mich.); or a combination of the ELVAX® 3200 or ENGAGE® 8200 material with one or more co-extruded layers. In a further embodiment of the present invention, the interior meltable layer comprises a co-extruded film having a layer of ELVAX® 3200 and a layer of SURLYN® 1702, an ethylene-methacrylic acid ionomer having a melt index of 15, also available from DuPont.

The interior meltable layer of the heat transfer material of the present invention may have a layer thickness, which varies considerably depending upon a number of factors including, but not limited to, the substrate to be coated, the press temperature, and the press time. Desirably, the interior meltable layer has a thickness of less than about 5 mil. (0.13 mm). More desirably, the interior meltable layer has a thickness of from about 0.5 mil. to about 4.0 mil. Even more desirably, the interior meltable layer has a thickness of from about 1.0 mil. to about 2.0 mil.

In addition to the interior meltable layer, the heat transfer material of the present invention comprises a release coating layer. The release coating layer separates the transferable material of the heat transfer sheet from the non-transferable material of the heat transfer sheet. Like the interior meltable layer, the release coating layer does not transfer to a coated substrate. Consequently, the release coating layer may comprise any material having release characteristics, which is also conformable when heated. Desirably, the release coating layer does not melt or become tacky when heated, and provides release of an image bearing coating during a hot or cold peelable transfer process. The release coating layer may be adjacent to a surface of the interior meltable layer or may be separated from the interior meltable layer by one or more layers.

A number of release coating layers are known to those of ordinary skill in the art, any of which may be used in the present invention. Typically, the release coating layer comprises a cross-linked polymer having essentially no tack at transfer temperatures (e.g. 177° C.) and a glass transition temperature of at least about 0° C. As used herein, the phrase "having essentially no tack at transfer temperatures" means that the release coating layer does not stick to an overlaying layer to an extent sufficient to adversely affect the quality of the transferred image. Suitable polymers include, but are not limited to, silicone-containing polymers, acrylic polymers and poly(vinyl acetate). Further, other materials having a low surface energy, such as polysiloxanes and fluorocarbon polymers, may be used in the release coating layer, particularly in cold peel applications. Desirably, the release coating layer comprises a cross-linked silicone-containing polymer or a cross-linked acrylic polymer. Suitable silicone-containing polymers include, but are not limited to, SYL-OFF® 7362, a silicone-containing polymer available from Dow Corning Corporation (Midland, Mich.). Suitable acrylic polymers include, but are not limited to, HYCAR® 26672, an acrylic latex available from B.F. Goodrich, Cleveland, Ohio; MICHEM® Prime 4983, an ethylene-acrylic acid copolymer dispersion available from Michelman Chemical Company, Cincinnati, Ohio; HYCAR® 26684, an acrylic latex also available from B.F. Goodrich, Cleveland, Ohio; and RHOPLEX® SP 100, an acrylic latex available from Rohm & Haas, Philadelphia, Pa.

The release coating layer may further contain additives including, but not limited to, a cross-lining agent, a release-modifying additive, a curing agent, a surfactant and a viscosity-modifying agent. Suitable cross-linking agents include, but are not limited to, XAMA7, an aziridine cross-linker available from B.F. Goodrich. Suitable release-modifying additives include, but are not limited to, SYL-OFF® 7210, a release modifier available from Dow Corning Corporation. Suitable curing agents include, but are not limited to, SYL-OFF® 7367, a curing agent available from Dow Corning Corporation. Suitable surfactants include, but are not limited to, TERGITOL® 15-S40, available from Union Carbide; TRITON® X100, available from Union Carbide; and Silicone Surfactant 190, available from Dow Corning Corporation. In addition to acting as a surfactant, Silicone Surfactant 190 also functions as a release modifier, providing improved release characteristics, particularly in cold peel applications.

The release coating layer may have a layer thickness, which varies considerably depending upon a number of factors including, but not limited to, the substrate to be coated, the thickness of the interior meltable layer, the press temperature, and the press time. Desirably, the release coating layer has a thickness, which does not restrict the flow of the interior meltable layer and, which provides a continuous physical barrier between the transferable material and the non-transferable material of the heat transfer sheet. Typically, the release coating layer has a thickness of less than about 1 mil. (26 microns). More desirably, the release coating layer has a thickness of from about 0.05 mil. to about 0.5 md. Even more desirably, the release coating layer has a thickness of from about 0.08 ml. to about 0.33 mil.

The thickness of the release coating layer may also be described in term of a basis weight. Desirably, the release coating layer has a basis weight of less than about 6 lb./144 $yd^2$ (22.5 gsm). More desirably, the release coating layer has a basis weight of from about 3.0 lb./144 $yd^2$ (11.3 gsm) to about 0.3 lb./144 $yd^2$ (1.1 gsm). Even more desirably, the release coating layer has a basis weight of from about 2.0 lb./144 $yd^2$ (7.5 gsm) to about 0.5 lb./144 $yd^2$ (1.9 gsm).

The heat transfer material of the present invention further comprises a surface meltable (or print coating) layer. Like the interior meltable layer, the surface meltable layer is capable of melting and conforming to the surface of a substrate to be coated. In addition, the surface meltable layer provides a print surface for the heat transfer sheet and is formulated to minimize feathering of a printed image and bleeding or loss of the image when the transferred image is exposed to water. The surface meltable layer is adapted to be printable by any method of printing including, but not limited to, ink jet printing, laser color copying, offset printing or other imaging methods. In some embodiments of the present invention, the surface meltable layer is adapted to be printable by an ink jet printer. In other embodiments, the surface meltable layer is adapted to be printable by color laser copiers. In still other embodiments, the surface meltable layer is adapted to be printable by thermal ribbon printers. Further, the surface meltable layer is capable of adhering directly to a given substrate, such as a T-shirt, or indirectly to the substrate via additional intermediate layers to insure good image washability.

Although the melt flow properties of the surface meltable layer are not critical to the present invention, it is desirable for the surface meltable layer to have a high melt flow index and a low softening point. Desirably, the surface meltable layer has a melt flow index of more than about 10, and a softening temperature of less than about 350° F. More desirably, the surface meltable layer has a melt flow index of from about 20 to about 20,000, and a softening temperature of from about 150° F. to about 300° F. Even more desirably, the surface meltable layer has a melt flow index of from about 30 to about 10,000, and a softening temperature of from about 200° F. to about 250° F.

The surface meltable layer of the heat transfer sheet of the present invention may include one or more components including, but not limited to, particulate thermoplastic materials, film-forming binders, a cationic polymer, a humectant, cyclohexane dimethanol dibenzoate, ink viscosity modifiers, weak acids, surfactants, a dispersent, a plasticizer, and a buffering agent. Each component of the surface meltable layer provides a particular feature to the printable layer.

The surface meltable layer may contain one or more thermoplastic particles. Desirably, the particles have a largest dimension of less than about 50 micrometers. More desirably, the particles have a largest dimension of less than about 20 micrometers. Suitable powdered thermoplastic polymers include, but are not limited to, polyolefins, polyesters, polyamides, and ethylene-vinyl acetate copolymers. In one embodiment of the present invention, the surface meltable layer contains thermoplastic particles in the form of micronized high density polyethylene powder available from Micropowders, Inc., Scarsdale, N.Y. under the tradenames MPP635VF and MPP635G; co-polyamide 6–12 particles having an average particle size of 10 microns available from Elf Atochem, Paris, France under the tradename ORGASOL® 3501 EXDNAT 1; polyester powder available from Image Polymers Inc., Wilmington, Mass. under the tradename ALMACRYL® P-501; or a combination thereof.

The surface meltable layer may also contain one or more film-forming binders. Desirably, the one or more film-forming binders are present in an amount of from about 10 to about 100 weight percent, based on the weight of the thermoplastic polymer. More desirably, the amount of binder is from about 10 to about 50 weight percent. Suitable binders include, but are not limited to, polyacrylates, polyethylenes, ethylene-acrylic acid copolymers, and ethylene-vinyl acetate copolymers. Desirably, the binders are heat-softenable at temperatures of less than or about 350° F. In one embodiment of the present invention, the surface meltable layer contains one or more film-forming binders in the form of an ethylene-acrylic acid copolymer dispersion available from Michelman, Chemical Company, Cincinnati, Ohio under the tradename MICHEM® Prime 4983; a similar ethylene-acrylic acid copolymer dispersion also available from Michelman, Chemical Company, Cincinnati, Ohio under the tradename MICHEM® Prime 4990; another ethylene-acrylic acid copolymer dispersion also available from Michelman, Chemical Company, Cincinnati, Ohio under the tradename MICHEM® Prime 4990R; or an ethylene-vinyl acetate copolymer binder available from Air Products, Allentown, Pa. under the tradename AIRFLEX® 540.

Further, the surface meltable layer may comprise a cationic polymer. In some instances, the cationic polymer enhances the retention of print on the surface of the surface meltable layer, particularly in the case of ink jet ink. Desirably, the cationic polymer is present in an amount from about 2 to about 20 weight percent, based on the weight of the thermoplastic polymer. Suitable cationic polymers include, but are not limited to, an amide-epichlorohydrin polymer, polyacrylamides with cationic functional groups, polyethyleneimines, and polydiallylamines. In one embodiment of the present invention, the surface meltable layer contains a cationic polymer in the form of a poly(N,N-dimethylethylamine methacrylate), quaternized with methyl chloride, available from Allied Colloids as a water solution under the tradename ALCOSTAT® 567 or a poly (diallyldimethyl)ammonium chloride, also available from Allied Colloids as a water solution under the tradename ALCOSTAT® 167.

The surface meltable layer of the heat transfer sheet may also contain one or more of the following: a surfactant and a viscosity modifier. Suitable surfactants include anionic, nonionic, or cationic surfactants. Desirably, the surfactant is a nonionic or cationic surfactant, such as those described above. Examples of anionic surfactants include, but are not limited to, linear and branched-chain sodium alkylbenzenesulfonates, linear and branched-chain alkyl sulfates, and linear and branched-chain alkyl ethoxy sulfates. Cationic surfactants include, but are not limited to, tallow trimethylammonium chloride. More desirably, the surfactant is a nonionic surfactant. Examples of nonionic surfactants include, but are not limited to, all polyethoxylates, polyethoxylated alkylphenols, fatty acid ethanol amides, complex polymers of ethylene oxide, propylene oxide, and alcohols, and polysiloxane polyethers. Suitable viscosity modifiers include, but are not limited to, a polyethylene oxide thickener available from Union Carbide under the tradename POLYOX® N60K; methylcellulose available from Dow Chemical under the tradename METHOCEL® A-15; and hydroxypropylcellulose available from Hercules (Wilmington, Del.) under the tradename KLUCEL® L.

In one embodiment of the present invention, the surface meltable layer comprises one or more of the above-described components and cyclohexane dimethanol dibenzoate. The amount of cyclohexane dimethanol dibenzoate in the surface meltable layer may vary depending on the overall coating composition. Desirably, the amount of cyclohexane dimethanol dibenzoate in the surface meltable layer is up to about 50 wt % based on the total weight percent of the dry coating layer. More desirably, the amount of cyclohexane dimethanol dibenzoate in the surface meltable layer is from about 10 wt % to about 30 wt % based on the total weight percent of the dry coating layer. Even more desirably, the amount of cyclohexane dimethanol dibenzoate in the surface meltable layer is from about 15 wt % to about 25 wt % based on the total weight percent of the dry coating layer.

In a further embodiment of the present invention, the surface meltable layer comprises a dispersent and/or a buffering agent. Suitable dispersents for the surface meltable layer of the present invention include, but are not limited to, KLUCEL® L; TRITON® X100; TAMOL® 731, available from Rohm & Haas; TERGITOL® 15-S40, available from Union Carbide. Suitable buffering agents for the surface meltable layer of the present invention include, but are not limited to, sodium carbonate.

The surface meltable layer of the heat transfer material of the present invention may have a layer thickness, which varies considerably depending upon a number of factors including, but not limited to, the substrate to be coated, the thickness of the interior meltable layer, the thickness of the release coating layer, the press temperature, and the press time. Desirably, the surface meltable layer has a thickness of less than about 2 mil. (52 microns). More desirably, the surface meltable layer has a thickness of from about 0.5 mil. to about 1.5 mil. Even more desirably, the surface meltable layer has a thickness of from about 0.7 mil. to about 1.5 mil.

The thickness of the surface meltable layer may also be described in term of a basis weight. Desirably, the surface meltable layer has a basis weight of less than about 12 lb./144 $yd^2$ (48 gsm). More desirably, the surface meltable layer has a basis weight of from about 8.0 lb./144 $yd^2$ (30.2 gsm) to about 2.0 lb./144 $yd^2$ (7.5 gsm). Even more desirably, the surface meltable layer has a basis weight of from about 8.0 lb./144 $yd^2$ (30.2 gsm) to about 3.0 lb./144 $yd^2$ (11.2 gsm).

In addition to the layers described above, the heat transfer sheet of the present invention may comprise a base substrate. Suitable base substrates include, but are not limited to, cellulosic nonwoven webs and polymeric filmns. A number of suitable base substrates are disclosed in U.S. Pat. Nos. 5,242,739; 5,501,902; and U.S. Pat. No. 5,798,179; the entirety of which are incorporated herein by reference. Desirably, the base substrate comprises paper. A number of different types of paper are suitable for the present invention including, but not limited to, common litho label paper, bond paper, and latex saturated papers.

The heat transfer material of the present invention may further comprise a sub-coating layer. The sub-coating layer may be positioned next to or separate from the surface meltable layer. Desirably, the sub-coating layer is directly above the release coating layer, so as to provide a desired amount of adhesion between the release coating layer and an overlaying layer, such as the surface meltable layer. The sub-coating layer provides an adequate amount of adhesion for manufacture, sheeting, handling, and printing of the heat transfer material, yet low enough adhesion for easy release after transfer. The sub-coating layer also provides protection to the surface meltable layer, which improves the washability of the transferred coating. A number of sub-coating layers are known to those of ordinary skill in the art, any of which may be used in the present invention. Suitable sub-coating layers for use in the present invention are disclosed in U.S. Pat. No. 5,798,179, the entirety of which is incorporated herein by reference.

In one embodiment of the present invention, the sub-coating layer of the heat transfer material comprises at least one film-forming binder material. The sub-coating layer of the heat transfer material may further comprise one or more powdered thermoplastic polymers. Suitable film-forming binder materials and powdered thermoplastic polymers include, but are not limited to, those described above. Desirably, the film-forming binder material is ethylene-acrylic acid copolymer dispersion available from Michelman, Chemical Company, Cincinnati, Ohio under the tradename MICHEM® Prime 4990 or an acrylic latex available from B.F. Goodrich, Cleveland, Ohio under the tradename HYCAR® 26684. Desirably, the thermoplastic polymer particles are co-polyamide 6–12 particles having an average particle size of 10 microns available from Elf Atochem, Paris, France under the tradename ORGASOL® 3501 EXDNAT 1; micronized high density polyethylene powder available from Micropowders, Inc., Scarsdale, N.Y. under the tradename MFP635VF; polyester powder available from Image Polymers Inc., Wilmington, Mass. under the tradename ALMACRYL® P-501; or a combination thereof. More desirably, the thermoplastic polymer particles are ORGASOL® 3501 EXDNAT 1 particles. The sub-coating layer may include other additives such as those described above for the surface meltable layer.

The thickness of the sub-coating layer may vary considerably depending upon the desired properties of the image-bearing transfer coating. Desirably, the sub-coating layer has a basis weight of less than about 6 lb./144 $yd^2$ (22.8 gsm). More desirably, the sub-coating layer has a basis weight of from about 5.0 lb./144 yd (18.9 gsm) to about 0.5 lb./144 $yd^2$ (1.9 gsm). Even more desirably, the sub-coating layer has a basis weight of from about 4.0 lb./144 $yd^2$ (15.1 gsm) to about 1.0 lb./144 $yd^2$ (3.8 gsm).

The heat transfer sheet of the present invention may further comprise a top coating layer to enhance absorption of ink jet inks and prevent feathering. The top coating layer may contain a wetting agent and an ink viscosity modifier. Desirably, the top coating layer comprises one or more cationic polymers. Suitable cationic polymers include, but are not limited to, poly(N,N-dimethylethylamino methacrylate), quarternized with methyl chloride, sold under the tradename, ALCOSTAT® 567 from Allied Colloids. Other materials may be added to the top coating layer including, but not limited to, plasticizers, surfactants, and viscosity modifiers. Suitable viscosity modifiers include, but are not limited to, polyethylene oxide available from Union Carbide under the tradename POLYOX® N60K, as well as, methylcellulose or hydroxyethyl cellulose. In one embodiment of the present invention, the heat transfer sheet includes a top coating layer comprising a mixture of 2 parts by weight (pbw) of ALCOSTAT® 567, 2 pbw of POLYOX® N60K, and 1 pbw of KLUCEL® L.

The thickness of the top coating layer may vary considerably depending upon a number of factors including, but not limited to, the desired properties of the image-bearing transfer coating, the type of print, and the printing means. Desirably, the top coating layer has a basis weight of less than about 2 lb./144 $yd^2$ (7.5 gsm). More desirably, the top coating layer has a basis weight of from about 1.0 lb./144 $yd^2$ (3.8 gsm) to about 0.1 lb./144 $yd^2$ (0.4 gsm). Even more desirably, the top coating layer has a basis weight of from about 0.75 lb./144 $yd^2$ (2.8 gsm) to about 0.25 lb./144 $yd^2$ (0.9 gsm).

The image-bearing coating of the heat transfer sheet, comprising one or more of the above-described coating layers, may be transferred to an article of clothing, or other porous substrate, by applying heat and pressure to the coating. Desirably, the image-bearing coating of the heat transfer sheet melts and penetrates into the interstices of the substrate, as opposed to merely coating the substrate surface. In order to penetrate into a fabric, the combined thickness of the sub-coating layer, surface meltable layer, and top coating layer, when present, is desirably greater than about 1.0 mil. More desirably, the combined thickness of the sub-coating layer, surface meltable layer, and top coating layer is about 1.5 to about 3 mils.

In the present invention, the first meltable layer also conforms to the surface of the fabric, or other substrate, which may have an irregular (not flat) surface. This further enhances the penetration of the second meltable layer into low areas of the material. However, since only the second meltable layer transfers, a minimal amount of polymer may be left on the surface of the fabric. Since the yarns of the fabric are free from excess polymer, which forms polymer bridges and fills the valleys between adjacent yarns, the fabric feel and stretch are much improved over conventionally transfer-coated fabrics.

The amount of polymer actually transferred to the fabric or substrate may be as little as about 10 grams per square meter (gsm), as opposed to conventional amounts in the range of about 50 gsm. Desirably, the basis weight of the image-bearing coating is less than about 40 gsm. More desirably, the basis weight of the image-bearing coating is less than about 30 gsm. Even more desirably, the basis weight of the image-bearing coating is less than about 20 gsm.

The present invention is also directed to a method of making a printable heat transfer material. The method comprises forming a first or interior meltable layer, applying a release coating layer onto the interior meltable layer, and applying a second or surface meltable coating onto the release coating layer. In one embodiment of the present invention, one or more of the above-described coating compositions are applied to the interior meltable layer by known coating techniques, such as by solution, roll, blade, and air-knife coating procedures. Each individual coating may be subsequently dried by any drying means known to those of ordinary skill in the art. Suitable drying means include, but are not limited to, steam-heated drums, air impingement, radiant heating, or a combination thereof. In an alternative embodiment, one or more of the above-described layers may be extrusion coated onto the surface of the interior meltable layer or a coating thereon. Any extrusion coating techniques, well known to those of ordinary skill in the art, may be used in the present invention.

In one embodiment of the present invention, a corona discharge process may be used to enhance the adhesion between the interior meltable layer and the release coating, applied to the interior meltable layer. Corona discharge methods are well known in the art. Suitable apparatus for performing the corona discharge step include, but are not limited to, treaters available from Enercon Industries, Corporation, Menomonee Falls, Wis. Desirably, the corona discharge step used in the present invention applies an amount of treatment to the interior meltable layer to produce a surface tension of greater than about 40 dynes. In some cases, the corona discharge step produces an interior meltable layer having a surface tension of from about 40 to 50 dynes. It should be noted that a corona discharge treatment may be applied to other layers of the heat transfer sheet, although such treatments are not necessary.

If desired, any of the foregoing coating layers may contain other materials, such as processing aids, release agents, pigments, deglossing agents, antifoam agents, and the like. The use of these and similar materials is well known to those having ordinary skill in the art.

The present invention is further directed to a method of transfer coating a substrate using the above-described heat transfer material. The method comprises applying a sufficient amount of heat and pressure to the heat transfer material to melt the interior meltable layer and the surface meltable layer of the heat transfer material, and removing the interior meltable layer and release layer from the coated substrate. Any known heating means may be used in the present invention including, but not limited to, a household iron and a commercial heating press. Heating temperature and press time may vary depending on a number of factors including, but not limited to, heating means, heating temperature, pressure applied, heat transfer sheet materials, and substrate structure.

The heat transfer sheet of the present invention may be used in hot peelable transfer processes, as well as, cold peelable transfer processes. As used herein, the phrase "hot peelable transfer process" refers to a process wherein one or more meltable layers is still in a molten state when a non-transferable portion of a heat transfer sheet is removed. Such a process allows release of the heat transfer sheet via splitting of the meltable layer(s). As used herein, the phrase "cold peelable transfer process" refers to a process wherein a non-transferable portion of a heat transfer sheet is removed from a transferable portion of the heat transfer sheet after the heat transfer sheet has cooled below the softening temperature of the transferable portion.

The present invention is further described by the examples which follow. Such examples, however, are not to be construed as limiting in any way either the spirit or scope of the present invention. In the examples, all parts are parts by weight unless stated otherwise.

EXAMPLES

Multiple transfers were performed using a variety of heat transfer materials. Each heat transfer sheet contained one or more of the following layers: base substrate; internal meltable layer; release coating layer; surface meltable layer; sub-coating layer; and top coating layer. A detailed description of each layer follows.

The coatings free of suspended particulate, such as some of the silicone release coatings, were made to the desired composition and dried to remove any solvent. Coatings containing suspended particulate were prepared using water as the dispersing medium. Water and/or solvent, if present in the coating, was removed by a drying step after applying the coating. Typically, drying took place for a period of about two minutes in a forced air oven at a temperature ranging from about 80° C. to 110° C. A lower temperature of about 80° C. was used to dry the ink jet print coatings. However, it should be noted that any drying step may be used to remove water from the coating as long as the drying step does not negatively impact the coating.

Coatings containing polymeric powders or plasticizers were dispersed by putting the coating through a colloid mill and/or Cowles mixer.

Base Substrates

BP1

BP1 was a 20 lb. (20 lb./144 $yd^2$) bond paper from Neenah Paper, Roswell, Ga., (a subsidiary of Kimberly-Clark Corporation) designated Avon Brilliant Classic Crest. The basis weight was 75 gsm and the thickness was 4 mils.

BP2

BP2 was a 20 lb. (20 lb./144 $yd^2$) paper impregnated with a saturant comprising 100 dry parts AIRVOL® 107 (polyvinyl alcohol from Air Products), 50 dry parts titanium dioxide, and 4 dry parts of a sizing agent, SUNSIZE® 137 (stearated melamine resin from Sequa Chemical, Chester, S.C.). The mixture was applied at about 12.5% total solids content in water. The saturant pickup was 15 parts per 100 parts fiber weight.

BP3

BP3 was a 22.5 lb. (22.5 lb./144 $yd^2$) litho label paper having a clay print coating on the backside. The paper was available from Interlake Paper Company, Wisconsin Rapids, Wis., under the tradename REPAP® 9365.

BP4

BP4 was a 13 lb. (13 lb./144 $yd^2$) base paper impregnated with an acrylic saturant comprising HYCAR® 26083, a soft acrylic latex (available from B.F. Goodrich, Cleveland, Ohio). The saturant pickup was 30 parts per 100 parts paper weight to yield a total weight of 16.9 lb./144 $yd^2$.

BP5

BP5 was a 15.2 lb. (15.2 lb./144 $yd^2$) base paper impregnated with an acrylic saturant comprising HYCAR® 26083. A frontside of the impregnated paper was coated with a 4.0 lb./144 $yd_2$ coating comprising 100 parts of ULTRAWHITE® 90 clay (available from Englehard, Iselin, N.J.) and 35 parts HYCAR® 26084 acrylic latex (available from B.F. Goodrich, Cleveland, Ohio). A backside of the impregnated paper was coated with a 5.5 lb./144 $yd^2$ coating comprising 100 parts ULTRAWHITE® 90 clay and 24 parts RHOPLEX® HA16 acrylic binder (available from Rohm & Haas Company, Philadelphia, Pa.).

BP6

BP6 was a 24 lb. (24 lb./144 $yd^2$) Neenah Avon Brilliant Classic Crest calendered to a thickness of 4.5 mils, available from Neenah Paper.

BP7

BP7 was a 24 lb. (24 lb./144 $yd^2$) Neenah Avon Brilliant Classic Crest calendered to a thickness of 3.5 mils.

Internal Meltable (Base Coating) Layers

BC1

BC1 was a film comprising NUCREL® 599, an ethylene-methacrylic acid co-polymer having a melt index of 500, available from Dupont. The film had a thickness of 1.8 mil.

BC2

BC2 was a film comprising a 50/50 blend of NUCREL® 599 and BYNEL® 1124, an ethylene-vinylacetate-acid copolymer having a melt index of 30, available from DuPont. The film had a thickness of 1.8 mil.

BC3

BC3 was a co-extruded film comprising a layer of ELVAX® 3200 (a wax modified EVA copolymer having a melt index of 30, available from DuPont) having a thickness of 1.2 mil., and a layer of SURLYN® 1702 (an ethylene-methacrylic acid ionomer having a melt index of 15, also available from DuPont) having a thickness of 0.6 mil.

BC4

BC4 was an extruded film comprising ELVAX® 3200 and having a thickness of 1.8 mil.

BC5

BC5 was an extruded film comprising ENGAGE® 8200, a metallocene catalyzed, highly branched, polyethylene, available from Dow Chemical Company (Midland, Mich.). The film had a thickness of 1.8 mil and a melt flow index of 5.

Release Coating Layers

All of the release coatings were applied to a substrate using a Meyer rod technique and dried in a forced air oven at about 225° F. (107° C.).

RC1

Release coating RC1 was a mixture of the following components:

| | |
|---|---|
| SANCOR ® 776 | 100 dry parts |
| XAMA7 | 5 dry parts |

SANCOR® 776 is a polyurethane emulsion available from B.F. Goodrich, Cleveland, Ohio.

XAMA7 is an aziridine cross-linker available from B.F. Goodrich.

The ingredients were mixed and applied to provide a dry coating weight of 1.5 lb./144 $yd^2$ or about 5.7 gsm.

RC2

Release coating RC2 was identical to RC1 except that the release coating was applied to provide a dry coating weight of 0.6 lb./144 $yd^2$ or about 2.3 gsm.

RC3

Release coating RC3 was a mixture of the following components:

| | |
|---|---|
| SANCOR ® 815 | 100 dry parts |
| XAMA7 | 5 dry parts |

SANCOR® 815 is a hard polyurethane emulsion available from B.F. Goodrich, Cleveland, Ohio.

The ingredients were mixed and applied to provide a dry coating weight of 0.6 lb./144 $yd^2$ or about 2.3 gsm.

RC4

Release coating RC4 was a mixture of the following components:

| | |
|---|---|
| SYL-OFF ® 7362 | 100 dry parts |
| SYL-OFF ® 7210 | 0.2 dry parts |
| SYL-OFF ® 7367 | 0.3 dry parts |

SYL-OFF® 7362 is a silicone polymer available from Dow Corning Corporation (Midland, Mich.).

SYL-OFF® 7210 is a release modifier available from Dow Corning Corporation.

SYL-OFF® 7367 is a curing agent available from Dow Corning Corporation.

The ingredients were dissolved in toluene at 16 wt % total solids content. The release coating was applied to provide a dry coating weight of 0.35 lb./144 $yd^2$ or about 1.3 gsm.

RC5

Release coating RC5 was identical to RC4 except that the release coating was applied to provide a dry coating weight of 0.7 lb./144 $yd^2$ or about 2.6 gsm.

RC6

Release coating RC6 was a mixture of the following components:

| | |
|---|---|
| SYL-OFF ® 7362 | 100 dry parts |
| SYL-OFF ® 7210 | 18.8 dry parts |
| SYL-OFF ® 7367 | 0.9 dry parts |

The ingredients were dissolved in toluene at 16 wt % total solids content. The release coating was applied to provide a dry coating weight of 0.7 lb./144 $yd^2$ or about 2.6 gsm.

RC7

Release coating RC7 was a mixture of the following components:

| | |
|---|---|
| SYL-OFF ® 7362 | 100 dry parts |
| SYL-OFF ® 7210 | 31.2 dry parts |
| SYL-OFF ® 7367 | 1.9 dry parts |

The ingredients were dissolved in toluene at 16 wt % total solids content. The release coating was applied to provide a dry coating weight of 0.35 lb./144 $yd^2$ or about 1.3 gsm.

RC8

Release coating RC8 was identical to RC7 except that the release coating was applied to provide a dry coating weight of 0.7 lb./144 $yd^2$ or about 2.6 gsm.

RC9

Release coating RC9 was identical to RC7 except that the release coating was applied to provide a dry coating weight of 1.0 lb./144 $yd^2$ or about 3.8 gsm.

RC10

Release coating RC10 was a mixture of the following components:

| | |
|---|---|
| HYCAR ® 26672 | 100 dry parts |
| CELITE ® 263 | 30 dry parts |
| NOPCOTE ® C-104 | 25 dry parts |
| Silicone Surfactant 190 | 10 dry parts |
| XAMA7 | 10 dry parts |
| TRITON ® X100 | 3 dry parts |
| ammonia | 2 parts |

HYCAR® 26672 is an acrylic latex available from B.F. Goodrich, Cleveland, Ohio.

CELITE® 263 is diatomaceous earth (de-glosser) available from Hydrite Chemical Company, Milwaukee, Wis.

NOPCOTE® C-104 is a 50% solids emulsion of calcium stearate available from Henkel Corporation, Ambler, Pa.

Silicone Surfactant 190 is a release agent available from Dow Corning.

TRITON® X100 is a nonionic surfactant available from Union Carbide.

The ingredients were mixed to provide 33 wt % total dry solids content. The release coating was applied to provide a dry coating weight of 1.5 lb./144 $yd^2$ or about 5.7 gsm.

RC11

Release coating RC11 was identical to RC10 except that the CELITB® 263 was not present. The release coating was applied to provide a dry coating weight of 0.3 lb./144 $yd_2$ or about 1.1 gsm.

RC12

Release coating RC12 was identical to RC10 except that the CELITE® 263 and NOPCOTE® C-104 were not present. The release coating was applied to provide a dry coating weight of 1.0 lb./144 $yd^2$ or about 3.8 gsm.

RC13

Release coating RC13 was a mixture of the following components:

| | |
|---|---|
| HYCAR ® 26672 | 100 dry parts |
| Silicone Surfactant 190 | 5 dry parts |
| XAMA7 | 10 dry parts |
| TRITON ® X100 | 3 dry parts |

-continued

| | |
|---|---|
| ammonia | 1 part |
| POLYOX ® N60K | 1 part |

POLYOX® N60K is a polyethylene oxide thickener available from Union Carbide, Danbury, Conn.

The ingredients were mixed to provide 33 wt % total dry solids content. The release coating was applied to provide a dry coating weight of 1.0 lb./144 $yd^2$ or about 3.8 gsm.

RC14

Release coating RC14 was identical to RC13 except that the release coating was applied to provide a dry coating weight of 0.5 lb./144 $yd^2$ or about 1.9 gsm.

RC15

Release coating RC15 was identical to RC13 except that the Silicone Surfactant 190 was not present. The release coating was applied to provide a dry coating weight of 1.0 lb./144 $yd^2$ or about 3.8 gsm.

RC16

Release coating RC16 was a mixture of the following components:

| | |
|---|---|
| MICHEM ® Prime 4983 | 100 dry parts |
| XAMA7 | 10 dry parts |
| TRITON ® X100 | 3 dry parts |
| ammonia | 2 parts |

MICHEM® Prime 4983 is an ethylene-acrylic acid copolymer dispersion available from Michelman, Chemical Company, Cincinnati, Ohio.

The ingredients were mixed to provide 33 wt % total dry solids content. The release coating was applied to provide a dry coating weight of 1.0 lb./144 $yd^2$ or about 3.8 gsm.

RC17

Release coating RC17 was a mixture of the following components:

| | |
|---|---|
| HYCAR ® 26684 | 100 dry parts |
| TRITON ® X100 | 10 dry parts |
| ammonia | 1 part |

HYCAR® 26684 is an acrylic latex available from B.F. Goodrich, Cleveland, Ohio.

The ingredients were mixed with water to provide 25 wt % total solids content. The release coating was applied to provide a dry coating weight of 1.0 lb./144 $yd^2$ or about 3.8 gsm.

RC18

Release coating RC18 was identical to RC12 except that the release coating was applied to provide a dry coating weight of 0.6 lb./144 $yd^2$ or about 2.3 gsm.

RC19

Release coating RC19 was a mixture of the following components:

| | |
|---|---|
| Q2-5211 | 0.2 dry parts |
| RHOPLEX ® SP-100 | 200 dry parts |
| CARBOWAX ® 8000 S.S. | 20 dry parts |
| Silicone Surfactant 190 | 4 dry parts |
| XAMA7 | 10 dry parts |
| ammonia | 1.1 parts |

Q2-5211 is a surfactant available from Dow Corning, Midland, Mich.

RHOPLEX® SP-100 is an acrylic latex available from Rohm & Haas, Philadelphia, Pa.

CARBOWAX® 8000 is a polyethylene oxide available from Union Carbide, Danbury, Conn.

The ingredients were mixed to provide 27.0 wt % total dry solids content. The pH was adjusted to within a range of 9 to 10. The XAMA7 was added to the mixture just prior to the coating process. The release coating was applied to provide a dry coating weight of 2.0 lb./144 $yd^2$ or about 7.5 gsm.

Print Coating (Surface Meltable) Layers-Thermal Wax Ribbon Printers

The following surface meltable coatings were used with Thermal Wax Ribbon printers. Each coating was applied using a Meyer rod technique and dried in a forced air oven at about 200° F. (93° C.). The particular Meyer rod used for a given coating (i.e., the Meyer rod number, such as number 6) was selected according to the desired basis weight of the final coating.

PCT1

Surface meltable coating PCT1 was a mixture of the following components:

| | |
|---|---|
| MPP635VF micropowder | 100 dry parts |
| TRITON ® X100 | 3 dry parts |
| MICHEM ® Prime 4983 | 50 dry parts |

MPP635VF micropowder is a micronized high density polyethylene powder available from Micropowders, Inc., Scarsdale, N.Y., having an average particle size of 6 microns.

The mixture was dispersed in a Colloid mill. The total solids content was 37 wt % total dry solids in water. The surface meltable coating was applied to provide a dry coating weight of 2.0 lb./144 $yd^2$ or about 7.5 gsm.

PCT2

Surface meltable coating PCT2 was identical to PCT1 except that the surface meltable coating was applied to provide a dry coating weight of 3.0 lb./144 $yd^2$ or about 11.3 gsm.

PCT3

Surface meltable coating PCT3 was identical to PCT1 except that the surface meltable coating was applied to provide a dry coating weight of 4.0 lb./144 $yd^2$ or about 15.1 gsm.

PCT4

Surface meltable coating PCT4 was a mixture of the following components:

| | |
|---|---|
| MPP635VF micropowder | 100 dry parts |
| TRITON ® X100 | 3 dry parts |
| MICHEM ® Prime 4983 | 100 dry parts |

The mixture was dispersed in a Colloid mill. The total solids content was 30 wt % total dry solids in water. The surface meltable coating was applied to provide a dry coating weight of 3.0 lb./144 $yd^2$ or about 11.3 gsm.

PCT5

Surface meltable coating PCT5 was identical to PCT4 except that the surface meltable coating was applied to provide a dry coating weight of 4.0 lb./144 $yd^2$ or about 15.1 gsm.

PCT6

Surface meltable coating PCT6 was a mixture of the following components:

| | |
|---|---|
| MPP635G micropowder | 100 dry parts |
| TRITON ® X100 | 3 dry parts |
| MICHEM ® Prime 4983 | 200 dry parts |

MPP635G micropowder is a micronized high density polyethylene powder having an average particle size of 12 microns, available from Micropowders, Inc., Scarsdale, N.Y.

The mixture was dispersed in a Colloid mill. The total solids content was 25 wt % total dry solids in water. The surface meltable coating was applied to provide a dry coating weight of 3.0 lb./144 $yd^2$ or about 11.3 gsm.

PCT7

Surface meltable coating PCT7 was identical to PCT6 except that the surface meltable coating was applied to provide a dry coating weight of 4.0 lb./144 $yd^2$ or about 15.1 gsm.

PCT8

Surface meltable coating PCT8 was a mixture of the following components:

| | |
|---|---|
| MICHEM ® Prime 4990 | 100 dry parts |
| ORGASOL ® 3501 EXDNAT 1 | 40 dry parts |
| BENZOFLEX ® 352 | 20 dry parts |
| MPP635VF micropowder | 20 dry parts |
| TRITON ® X100 | 3 dry parts |

MICHEM® Prime 4990 is an ethylene-acrylic acid copolymer dispersion available from Michelman, Chemical Company, Cincinnati, Ohio.

ORGASOL® 3501 EXDNAT 1 is a 10 micron average particle size co-polyamide 6–12 available from Elf Atochem, Paris, France.

BENZOFLEX® 352 is a cyclohexane dimethanol dibenzoate powder available from VELSICOL® Chemical Corporation, Rosemont, Ill.

The BENZOFLEX® 352 powder was ground to an average particle size of about 8 microns by Powdersize, Inc., Quakertown, Pa. The mixture was dispersed in a Colloid mill. The total solids content was 30 wt % total dry solids in water. The surface meltable coating was applied to provide a dry coating weight of 3.0 lb./144 $yd^2$ or about 11.3 gsm.

PCT9

Surface meltable coating PCT9 was identical to PCT8 except that the surface meltable coating was applied to provide a dry coating weight of 4.0 lb./144 $yd^2$ or about 15.1 gsm.

Print Coating (Surface Meltable) Layers-Laser Copiers

The following surface meltable coatings were used with Laser copiers. Each coating was applied using a Meyer rod technique and dried in a forced air oven at about 200° F. (93° C.).

LCP1

Surface meltable coating LCP1 was identical to PCT8.

LCP2

Surface meltable coating LCP2 was identical to PCT9.

LCP3

Surface meltable coating LCP3 was identical to PCT8 except that the surface meltable coating was applied to provide a dry coating weight of 2.0 lb./144 $yd^2$ or about 7.5 gsm.

LCP4

Surface meltable coating LCP4 was identical to PCT4.

LCP5

Surface meltable coating LCP5 was a mixture of the following components:

| | |
|---|---|
| MICHEM ® Prime 4990 | 100 dry parts |
| ORGASOL ® 3501 EXDNAT 1 | 100 dry parts |
| TRITON ® X100 | 5 dry parts |

The mixture was dispersed in a Colloid mill. The total solids content was 30 wt % total dry solids in water. The surface meltable coating was applied to provide a dry coating weight of 2.5 lb./144 $yd^2$ or about 9.4 gsm.

LCP6.

Surface meltable coating LCP6 was a mixture of the following components:

| | |
|---|---|
| MICHEM ® Prime 4990 | 100 dry parts |
| ALMACRYL ® P-501 | 100 dry parts |
| TRITON ® X100 | 3 dry parts |

ALMACRYL® P-501 is a powdered polyester available from Image Polymers Inc., Wilmington, Mass.

The mixture was dispersed in a Colloid mill. The total solids content was 30 wt % total dry solids in water. The surface meltable coating was applied to provide a dry coating weight of 2.3 lb./144 $yd^2$ or about 8.7 gsm.

Print Coating (Surface Meltable) Layers-Ink Jet Printers

The following surface meltable coatings were used with ink jet printers. Each coating was applied using a Meyer rod technique and dried in a forced air oven at about 180° F. (82° C.).

PIJ1

Ink jet print coating PIJ1 was a mixture of the following components:

| | |
|---|---|
| ORGASOL ® 3501 EXDNAT 1 | 100 dry parts |
| ALMACRYL ® P-501 | 50 dry parts |
| MICHEM ® Prime 4990 | 25 dry parts |
| TERGITOL ® 15-S40 | 5 dry parts |
| Sodium carbonate | 2 dry parts |
| POLYOX ® N60K | 4 dry parts |
| ALCOSTAT ® 567 | 2 dry parts |
| METHOCEL ® A-15 | 1 dry part |

ALCOSTAT® 567 is a poly(N,N-dimethylethylamino methacrylate), quaternized with methyl chloride, available from Allied Colloids (Suffolk, Va.) as a water solution.

METHOCEL® A-15 is a methylcellulose available from Dow Chemical Company, Midland, Mich.

The mixture was dispersed in a Colloid mill. The total solids content was 30 wt % total dry solids in water. The print coating was applied to provide a dry coating weight of 5.5 lb./144 $yd^2$ or about 20.7 gsm.

PIJ2

Ink jet print coating PIJ2 was a mixture of the following components:

| | |
|---|---|
| ORGASOL ® 3501 EXDNAT 1 | 100 dry parts |
| MICHEM ® Prime 4990 | 25 dry parts |
| TRITON ® X100 | 5 dry parts |

-continued

| | |
|---|---|
| Sodium carbonate | 1 dry part |
| POLYOX ® N60K | 2 dry parts |

The mixture was dispersed in a Colloid mill. The total solids content was 30 wt % total dry solids in water. The print coating was applied to provide a dry coating weight of 4.0 lb./144 $yd^2$ or about 15.1 gsm.

PIJ3

Ink jet print coating PIJ3 was a mixture of the following components:

| | |
|---|---|
| ORGASOL ® 3501 EXDNAT 1 | 100 dry parts |
| MICHEM ® Prime 4990 | 45 dry parts |
| TRITON ® X100 | 5 dry parts |
| Sodium carbonate | 1 dry part |
| KLUCEL ® L | 5 dry parts |
| BENZOFLEX ® 352 | 40 dry parts |

The BENZOFLEX® 352 powder was ground to an average particle size of about 8 microns by Powdersize, Inc. The mixture was dispersed in a Colloid mill. The total solids content was 30 wt % total dry solids in water. The print coating was applied to provide a dry coating weight of 3.5 lb./144 $yd^2$ or about 13.2 gsm.

PIJ4

Ink jet print coating PIJ4 was identical to PIJ3 except that the ink jet print coating was applied to provide a dry coating weight of 5.0 lb./144 $yd^2$ or about 18.9 gsm.

PIJ5

Ink jet print coating PIJ5 was a mixture of the following components:

| | |
|---|---|
| ORGASOL ® 3501 EXDNAT 1 | 100 dry parts |
| AIRFLEX ® 540 | 10 dry parts |
| POLYOX ® N60K | 10 dry parts |
| ALCOSTAT ® 167 | 5 dry parts |
| TRITON ® X100 | 5 dry parts |

AIRFLEX® 540 is an ethylene-vinyl acetate copolymer binder available from Air Products, Allentown, Pa.

The mixture was dispersed in a Colloid mill. The total solids content was 17 wt % total dry solids in water. The print coating was applied to provide a dry coating weight of 2.5 lb./144 $yd^2$ or about 9.4 gsm.

PIJ6

Ink jet print coating PIJ6 was a mixture of the following components:

| | |
|---|---|
| ORGASOL ® 3501 EXDNAT 1 | 100 dry parts |
| AIRFLEX ® 540 | 20 dry parts |
| POLYOX ® N60K | 5 dry parts |
| ALCOSTAT ® 167 | 2.5 dry parts |
| TRITON ® X100 | 5 dry parts |

The mixture was dispersed in a Colloid mill. The total solids content was 23 wt % total dry solids in water. The print coating was applied to provide a dry coating weight of 4.0 lb./144 $yd^2$ or about 15.1 gsm.

PIJ7

Ink jet print coating PIJ7 was a mixture of the following components:

| | |
|---|---|
| ORGASOL ® 3501 EXDNAT 1 | 100 dry parts |
| MICHEM ® Prime 4990 | 25 dry parts |
| TRITON ® X100 | 5 dry parts |
| Sodium carbonate | 1 dry part |
| POLYOX ® N60K | 2 dry parts |
| ALCOSTAT ® 167 | 3 dry parts |

The mixture was dispersed in a Colloid mill. The total solids content was 30 wt % total dry solids in water. The print coating was applied to provide a dry coating weight of 5.0 lb./144 $yd^2$ or about 18.9 gsm.

PIJ8

Ink jet print coating PIJ8 was a mixture of the following components:

| | |
|---|---|
| ORGASOL ® 3501 EXDNAT 1 | 100 dry parts |
| MICHEM ® Prime 4990 | 45 dry parts |
| TRITON ® X100 | 5 dry parts |
| Sodium carbonate | 1 dry part |
| KLUCEL ® L | 5 dry parts |
| BENZOFLEX ® 352 | 40 dry parts |
| ALCOSTAT ® 167 | 3 dry parts |

The BENZOFLEX® 352 powder was ground to an average particle size of about 8 microns by Powdersize, Inc. The mixture was dispersed in a Colloid mill. The total solids content was 30 wt % total dry solids in water. The print coating was applied to provide a dry coating weight of 5.0 lb./144 $yd^2$ or about 18.9 gsm.

PIJ9

Ink jet print coating PIJ9 was a mixture of the following components:

| | |
|---|---|
| ORGASOL ® 3501 EXDNAT 1 | 100 dry parts |
| MICHEM ® Prime 4990 | 25 dry parts |
| TRITON ® X100 | 5 dry parts |
| POLYOX ® N60K | 2 dry parts |
| ALCOSTAT ® 167 | 5 dry parts |

The mixture was dispersed in a Colloid mill. The total solids content was about 25 wt % total dry solids in water. The print coating was applied to provide a dry coating weight of 4.0 lb./144 $yd^2$ or about 15.0 gsm.

PIJ10

Ink jet print coating PIJ10 was a mixture of the following components:

| | |
|---|---|
| ORGASOL ® 3501 EXDNAT 1 | 100 dry parts |
| MICHEM ® Prime 4990 | 25 dry parts |
| AIRFLEX ® 540 | 10 dry parts |
| TRITON ® X100 | 5 dry parts |
| POLYOX ® N60K | 1 dry parts |
| ALCOSTAT ® 167 | 2 dry parts |

The mixture was dispersed in a Colloid mill. The total solids content was about 25 wt % total dry solids in water. The print coating was applied to provide a dry coating weight of 4.0 lb./144 $yd^2$ or about 15.0 gsm.

PIJ11

Ink jet print coating PIJ11 was a mixture of the following components:

| | |
|---|---|
| TRITON ® X100 | 1 dry part |
| BENZOFLEX ® 352 | 41.2 dry parts |
| KLUCEL ® L | 5 dry parts |
| ORGASOL ® 3501 EXDNAT 1 | 100 dry parts |
| MICHEM ® Prime 4990R | 85 dry parts |
| KLUCEL ® L/ALCOSTAT ® 167 | 8 dry parts |
| ammonia | 2 parts |

KLUCEL® L is a hydroxypropyl cellulose available from Hercules, Wilmington, Del.

ALCOSTAT® 167 is a poly(diallyldimethylammonium) chloride, available from Allied Colloids (Suffolk, Va.) as a water solution.

The BENZOFLEX® 352 powder was ground to an average particle size of about 8 microns by Powdersize, Inc., Quakertown, Pa. The first four components of the mixture were dispersed in a Cowles dissolver for about 30 minutes. The MICHEM® Prime 4990R and ammonia were then added. Lastly, the KLUCEL® L/ALCOSTAT® 167 mixture was added. The KLUCEL® L/ALCOSTAT® 167 mixture comprised 1 dry part KLUCEL® L and 3 dry parts ALCOSTAT® 167.

The total solids content of the coating was 23.8 wt % total dry solids in water. The surface meltable coating was applied to provide a dry coating weight of 4.5 lb./144 $yd^2$ or about 17.0 gsm.

Sub-Coating Layers

The following layers were used as sub-coating layers between a release layer and a print coating layer, particularly ink jet print coating layers. Each coating was applied using a Meyer rod technique and dried in a forced air oven at about 200° F. (93° C.).

SC1

Sub-coating SC1 was a mixture of the following components:

| | |
|---|---|
| MICHEM ® Prime 4990 | 100 dry parts |
| TRITON ® X100 | 3 dry parts |

The total solids content was about 30 wt % total dry solids in water. The sub-coating was applied to provide a dry coating weight of 1.9 lb./144 $yd^2$ or about 7.2 gsm.

SC2

Sub-coating SC2 was identical to LCP5.

SC3

Sub-coating SC3 was identical to LCP6.

SC4

Sub-coating SC4 was a mixture of the following components:

| | |
|---|---|
| HYCAR ® 26672 | 100 dry parts |
| TERGITOL ® 15-S40 | 3 dry parts |

The total solids content was about 20 wt % total dry solids in water. The sub-coating was applied to provide a dry coating weight of 0.7 lb./144 $yd^2$ or about 2.6 gsm.

SC5

Sub-coating SC5 was a mixture of the following components:

| | |
|---|---|
| HYCAR ® 26672 | 50 dry parts |
| MICHEM ® Prime 4990 | 50 dry parts |
| TERGITOL ® 15-S40 | 3 dry parts |

The total solids content was about 30 wt % total dry solids in water. The sub-coating was applied to provide a dry coating weight of 1.8 lb./144 $yd^2$ or about 6.8 gsm.

SC6

Sub-coating SC6 was a mixture of the following components:

| | |
|---|---|
| MICHEM ® Prime 4983 | 100 dry parts |

The total solids content was about 25 wt % total dry solids in water. The sub-coating was applied to provide a dry coating weight of 2.0 lb./144 $yd^2$ or about 7.5 gsm.

SC7

Sub-coating SC7 was identical to PCT8.

SC8

Sub-coating SC8 was a mixture of the following components:

| | |
|---|---|
| BENZOFLEX ® 352 | 50 dry parts |
| ORGASOL ® 3501 EXDNAT 1 | 25 dry parts |
| MICHEM ® Prime 4990 | 35 dry parts |

The BENZOFLEX® 352 powder was ground to an average particle size of about 8 microns by Powdersize, Inc. The mixture was dispersed in a Colloid mill. The total solids content was about 30 wt % total dry solids in water. The sub-coating was applied to provide a dry coating weight of 3.0 lb./144 $yd^2$ or about 11.3 gsm.

SC9

Sub-coating SC9 was a mixture of the following components:

| | |
|---|---|
| BENZOFLEX ® 352 | 70 dry parts |
| MICHEM ® Prime 4990 | 30 dry parts |
| TRITON ® X100 | 2.1 dry parts |

The BENZOFLEX® 352 powder was ground to an average particle size of about 8 microns by Powdersize, Inc. The mixture was dispersed in a Colloid mill. The total solids content was about 30 wt % total dry solids in water. The sub-coating was applied to provide a dry coating weight of 4.0 lb./144 $yd^2$ or about 15.1 gsm.

SC10

Sub-coating SC10 was a mixture of the following components:

| | |
|---|---|
| MICHEM ® Prime 4990 | 100 dry parts |
| ORGASOL ® 3501 EXDNAT 1 | 40 dry parts |
| TRITON ® X100 | 2 dry parts |

The mixture was dispersed in a Colloid mill. The total solids content was about 30 wt % total dry solids in water.

The sub-coating was applied to provide a dry coating weight of 4.0 lb./144 yd $^2$ or about 15.1 gsm.

SC11

Sub-coating SC11 was a mixture of the following components:

| | |
|---|---|
| MICHEM ® Prime 4990 | 100 dry parts |
| ORGASOL ® 3501 EXDNAT 1 | 40 dry parts |
| BENZOFLEX ® 352 | 40 dry parts |
| TERGITOL ® 15-S40 | 2 dry parts |
| POLYOX ® N60K | 1 dry parts |
| ammonia | 0.55 parts |
| isopropyl alcohol | drops (to defoam) |

TERGITOL® 15-S40 is an ethoxylated alcohol surfactant available from Union Carbide (Danbury, Conn.).

The BENZOFLEX® 352 powder was ground to an average particle size of about 8 microns by Powdersize, Inc., Quakertown, Pa. The mixture was dispersed in a Cowles dissolver, a high shear mixer, for about 30 minutes. The total solids content was 33.8 wt % total dry solids in water. Drops of isopropyl alcohol were added as needed to control foaming. The surface meltable coating was applied to provide a dry coating weight of 4.5 lb./144 yd$^2$ or about 17.0 gsm.

Top Coat Layers

The following layer was used as a top coating layer for overcoating a print coating layer, particularly ink jet print coating layers. The layer was applied using a Meyer rod technique and dried in a forced air oven at about 180° F. (82° C.).

TC1

Top coating layer TC1 was a mixture of the following components:

| | |
|---|---|
| POLYOX ® N60K | 0.66 dry parts |
| ALCOSTAT ® 167 | 0.66 dry parts |
| KLUCEL ® L | 0.33 dry parts |

The mixture was dispersed in a Colloid mill. The total solids content was 1.65 wt % total dry solids in water. The top coating was applied to provide a dry coating weight of 0.25 lb./144 yd$^2$ or about 0.9 gsm.

EXAMPLE 1

Preparation of Heat Transfer Materials Having a Thermal Ribbon Printed Image Thereon Heat transfer materials were prepared from the above-described layers. The components of the heat transfer materials are shown below in Table 1. Images were printed onto the heat transfer materials using a thermal ribbon printer.

TABLE 1

Thermal Ribbon Printable Designs

| Sample # | Base Paper | Base Coat | Release Coat | Print Coat |
|---|---|---|---|---|
| TR1 | BP3 | BC1 | RC1 | PCT1 |
| TR2 | BP3 | BC1 | RC2 | PCT2 |
| TR3 | BP3 | BC1 | RC2 | PCT4 |
| TR4 | BP3 | BC1 | RC3 | PCT4 |
| TR5 | BP3 | BC1 | RC4 | PCT4 |
| TR6 | BP3 | BC1 | RC5 | PCT4 |
| TR7 | BP3 | BC1 | RC5 | LCP5 |
| TR8 | BP1 | BC2 | RC6 | LCP5 |

TABLE 1-continued

Thermal Ribbon Printable Designs

| Sample # | Base Paper | Base Coat | Release Coat | Print Coat |
|---|---|---|---|---|
| TR9 | BP1 | BC2 | RC6 | LCP6 |
| TR10 | BP1 | BC2 | RC6 | PCT4 |
| TR11 | BP1 | BC2 | RC13 | PCT2 |
| TR12 | BP1 | BC2 | RC14 | PCT4 |
| TR13 | BP1 | BC2 | RC14 | PCT9 |
| TR14 | BP1 | BC2 | RC15 | PCT6 |
| TR15 | BP1 | BC2 | RC16 | PCT9 |
| TR16* | BP3 | BC1 | NONE | PCT1 |

*Comparative example having no release coat.

Comparative example having no release coat.

For good thermal ribbon printing results, smoothness of the base substrate is known to be a desirable factor. Better printing results are obtained when there is good contact between the heat transfer sheet and the ribbon. Further, the smoothness of the surface meltable (print) coating layer is known to be a desirable factor for producing good print results. Better print results are obtained when the surface meltable (print) coating bonds well to the wax ribbon pigments. Coatings containing meltable ethylene-acrylic acid copolymer binders with meltable, fine particulate polymers worked particularly well.

A surface meltable layer coating basis weight of as little as about 3 lb. per 144 yd$^2$ (11.3 gsm) was suitable for use with the thermal ribbon printers.

Each sample was tested for color wash retention, "hand," and tackiness. As used herein, the term "hand" is used in its customary way (i.e., the feel and stiffness of a given sample). The results are given in Table 4 below.

EXAMPLE 2

Preparation of Heat Transfer Materials Having a Laser Color Copier Printed Image Thereon Heat transfer materials were prepared from the above-described layers using the procedure outlined in Example 1. The components of the heat transfer materials are shown below in Table 2. Images were copied onto the heat transfer materials using a Canon 700 laser color copier.

TABLE 2

Color Laser Copier Designs

| Sample | Base Paper | Base Coat | Release Coat | Print Coat |
|---|---|---|---|---|
| CLC1 | BP1 | BC2 | RC5 | PCT4 |
| CLC2 | BP1 | BC2 | RC5 | LCP5 |
| CLC3 | BP1 | BC2 | RC5 | LCP6 |
| CLC4 | BP1 | BC2 | RC14 | PCT8 |
| CLC5 | BP1 | BC2 | RC14 | PCT9 |
| CLC6 | BP1 | BC2 | RC14 | LCP3 |
| CLC7 | BP1 | BC2 | RC16 | PCT9 |
| CLC8* | BP1 | BC2 | | |
| CLC9** | BP6 | | RC10 | BC1 |

*Comparative example using hot removal of paper, having a single layer of meltable coating.

**Comparative example using cold removal of paper, having a release coat and an outside single layer of meltable coating.

Bond papers such as BP1 and BP6 in the tables above worked well for photocopier grades, due to their stiffness, conductivity, caliper, and smoothness required for photocopying.

For photocopying, the surface meltable or top coating does not need to be as smooth as in thermal ribbon printing.

Very similar coating compositions to the thermal ribbon types worked well for photocopying.

A surface meltable layer coating basis weight of as little as about 3 lb. per 144 $yd^2$ (11.3 gsm) was suitable for use with photocopying.

Each sample was tested for color wash retention, "hand," and tackiness. The results are given in Table 5 below.

EXAMPLE 3

Preparation of Heat Transfer Materials Having an Ink Jet Printed Image Thereon

Heat transfer materials were prepared from the above-described layers using the procedure outlined in Example 1. The components of the heat transfer materials are shown below in Table 3. Images were printed onto the heat transfer materials using an ink jet printer;

TABLE 3

Ink Jet Printable Designs

| Sample | Base Paper | Base Coat | Release Coat | Sub-Coat | Print Coat | Top Coat |
|---|---|---|---|---|---|---|
| IJ1 | BP3 | BC1 | RC6 | SC1 | PIJ1 | NONE |
| IJ2 | BP3 | BC1 | RC6 | LCP5 (SC2) | PIJ1 | NONE |
| IJ3 | BP3 | BC1 | RC6 | LCP6 (SC3) | PIJ1 | NONE |
| IJ4 | BP2 | BC3 | RC6 | SC4 | PIJ1 | NONE |
| IJ5 | BP2 | BC3 | RC6 | SC5 | PIJ1 | NONE |
| IJ6 | BP2 | BC1 | RC10 | NONE | PIJ2 | TC1 |
| IJ7 | BP1 | BC2 | RC11 | NONE | PIJ2 | TC1 |
| IJ8 | BP1 | BC2 | RC11 | SC6 | PIJ2 | TC1 |
| IJ9 | BP1 | BC2 | RC11 | SC7 (PCT8) | PIJ2 | TC1 |
| IJ10 | BP1 | BC2 | RC11 | SC8 | PIJ2 | TC1 |
| IJ11 | BP1 | BC2 | RC11 | SC9 | PIJ2 | TC1 |
| IJ12 | BP1 | BC2 | RC11 | NONE | PIJ2 | NONE |
| IJ13 | BP1 | BC2 | RC11 | NONE | PIJ3 | TC1 |
| IJ14 | BP1 | BC2 | RC12 | NONE | PIJ2 | NONE |
| IJ15 | BP1 | BC2 | RC12 | NONE | PIJ2 | TC1 |
| IJ16 | BP1 | BC2 | RC12 | PCT8 | PIJ2 | NONE |
| IJ17 | BP1 | BC2 | RC12 | PCT8 | PIJ2 | TC1 |
| IJ18 | BP1 | BC2 | RC12 | NONE | PIJ5 | NONE |
| IJ19 | BP1 | BC2 | RC12 | NONE | PIJ6 | NONE |
| IJ20 | BP1 | BC2 | RC10 | NONE | PIJ6 | NONE |
| IJ21 | BP1 | BC2 | RC10 | NONE | PIJ9 | NONE |
| IJ22 | BP1 | BC2 | RC10 | NONE | PIJ4 | TC1 |
| IJ23 | BP1 | BC2 | RC13 | NONE | PIJ4 | TC1 |
| IJ24 | BP1 | BC2 | RC14 | NONE | PIJ4 | TC1 |
| IJ25 | BP1 | BC2 | RC13 | SC9 | PIJ4 | TC1 |
| IJ26 | BP1 | BC2 | RC14 | SC9 | PIJ4 | TC1 |
| IJ27 | BP1 | BC2 | RC13 | NONE | PIJ7 | NONE |
| IJ28 | BP1 | BC2 | RC13 | SC9 | PIJ7 | NONE |
| IJ29 | BP1 | BC2 | RC13 | NONE | PIJ8 | NONE |
| IJ30 | BP1 | BC2 | RC17 | NONE | PIJ8 | NONE |
| IJ31* | BP6 | NONE | RC10 | BC1 | PIJ2 | TC1 |
| IJ32* | BP6 | NONE | RC10 | BC1 | PIJ3 | TC1 |
| IJ33** | BP3 | NONE | NONE | BC1 | PIJ2 | TC1 |
| IJ34 | BP7 | BC4 | RC12 | SC10 | PIJ10 | NONE |
| IJ35 | BP7 | BC4 | RC12 | SC9 | PIJ10 | NONE |
| IJ36 | BP7 | BC4 | RC18 | SC10 | PIJ10 | NONE |
| IJ37 | BP7 | BC5 | RC12 | SC10 | PIJ10 | NONE |
| IJ38 | BP7 | BC5 | RC18 | SC10 | PIJ10 | NONE |
| IJ39 | BP6 | BC5 | RC19 | SC11 | PIJ11 | NONE |

*Comparative example having a meltable layer only on the outer surface of the release coat. Cold removal of paper.
**Comparative example having no release coat and hot removal of paper.

For ink jet printing, any of the base papers were suitable. As far as ink jet printing results, surface meltable or top coating containing polyamide powder, ORGASOL® 3501 EXD NAT 1, provided the best results. The polyamide powders were very receptive to the ink jet inks. Further, the melting point and melt viscosity were low enough and the particle size was particularly suitable for the formation of a microporous coating.

MICHEM® Prime EAA suspensions were again determined to be the binders of choice, although acceptable results were also obtained with an EVA latex, AIRFLEX® 540. AIRFLEX® 540 did not melt and flow as well as the MICHEM® Prime EAA suspensions. Retention of the ink jet inks was enhanced by the addition of a cationic polymer, particularly ALCOSTAT® 167. ALCOSTAT® 167 was determined to be compatible with the non-ionic latex AIRFLEX® 540. Compatibility of ALCOSTAT® 167 with anionic MICHEM® Prime 4990 was improved by the addition of TRITON® X100 and KLUCEL® L or POLYOX® N60K.

For ink jet printing, better print results were obtained with a surface meltable coating basis weight of from about 4.0 lb./144 $yd^2$ to about 5.0 lb./144 $yd^2$.

Each sample was tested for color wash retention, "hand," and tackiness. The results are given in Table 6 below.

EXAMPLE 4

Testing of Heat Transfer Materials Having a Thermal Ribbon Printed Image Thereon Transfers of the images were made using a hand ironing technique or a heating press. A cushioning material was placed onto a hard surface. A piece of cloth or blotter paper was suitable as a cushioning material. A substrate to be coated was then placed onto the cushioning material. Then, the heat transfer material was placed onto the substrate.

When an iron was used, the heat transfer material was ironed for three minutes, applying pressure onto the heat transfer material. The ironing strokes were slow and in the longest direction of the heat transfer material. The iron used was a Procter-Silex model 17109 or 13117. When a heating press was used, the heat transfer material was pressed for up to 30 seconds. The images were multi-colored test patterns covering nearly all the heat transfer material surface. The heat transfer material was removed after cooling.

The heat transfer materials described in Table 1 above were transferred to substrates using a hot or cold peelable method. The substrates used were either 100% cotton T-shirt material (cotton) or 50/50 cotton/polyester (cotton/poly) material. The heat pressed samples were pressed for 30 sec at 350° F. using a Hix Model 600 press from Hix Corporation, Pittsburg, Kans. A few of the heat pressed samples were also pressed for 10 sec at 350° F. using the same equipment.

The coated substrates were tested for the following properties: color wash retention, "hand," and tackiness. For each property, a number value from "1" to "5" was assigned. The rating system is explained below.

A rating of "5" in color retention indicated that there was a noticable, but small, decrease in color intensity after five washings. A rating of "1" indicated that very little color remained after five washings. Ratings of "2" to "4" indicated progressively poorer color retention from "4" to "2".

A rating of "5" in hand indicated that the difference in feel between the original fabric and the image-bearing fabric was barely noticable. A rating of "1" indicated that the image-bearing fabric was very stiff, smooth, and non-porous. Ratings of "2" to "4" indicated progressively poorer hand from "4" to "2".

A rating of "5" in tackiness indicated that two image-bearing fabrics did not adhere to one another after being pressed together on a heat transfer press at 215° F. and subsequently cooled. A rating of "1" indicated that the two image-bearing fabrics adhered strongly to one another after the above-described test, resulting in damaged images. Ratings of "2" to "4" indicated progressively more tackiness from "2" to "4".

The testing results are shown below in Table 4.

TABLE 4

Thermal Ribbon Print Test Results

| Sample | Fabric | Transfer Method | Paper Removal | Color Wash Retention | "Hand" | Tackiness | Other |
|---|---|---|---|---|---|---|---|
| TR1 | Cotton | Press | Hot | 1 | 5 | 5 | 1 |
| TR2 | Cotton | Press | Hot | 2 | 5 | 5 | |
| TR3 | Cotton | Press | Hot | 3 | 5 | 5 | |
| TR4 | Cotton | Press | Hot | 1 | 5 | 5 | 1 |
| TR5 | Cotton | Press | Cold | 3 | 3 | 5 | 2, 3 |
| TR6 | Cotton | Press | Cold | 3 | 5 | 5 | 2 |
| TR7 | Cotton | Press | Cold | 3 | 5 | 5 | 2 |
| TR8 | Cotton | Press | Cold | 3 | 5 | 5 | 2 |
| TR9 | Cotton | Press | Cold | 3 | 5 | 5 | 2 |
| TR10 | Cotton | Press | Cold | 3 | 5 | 5 | 2 |
| TR11 | Cotton/Poly | Press | Cold | 3 | 4 | 5 | 4 |
| TR12 | Cotton/Poly | Press | Cold | 4 | 4 | 5 | 4 |
| TR13 | Cotton/Poly | Press | Cold | 5 | 4 | 5 | 4 |
| TR14 | Cotton/Poly | Press | Hot | 4 | 5 | 5 | 6 |
| TR13 | Cotton | Iron | Cold | 5 | 4 | 5 | 6 |
| TR14 | Cotton/Poly | Iron | Hot | | 5 | 5 | 5 |
| TR15 | Cotton/Poly | Press* | Hot | 4 | 5 | 5 | |
| TR15 | Cotton/Poly | Iron | Hot | | 5 | 5 | 5 |
| TR16 | Cotton/Poly | Press* | Hot | 4 | 3 | 3 | 7 |

*Transferred well after 10 sec. pressing also.
Other key:
1. Incomplete transfer.
2. The surface meltable (print) coating contained voids due to the water repellancy of the release coating.
3. Some of the interior meltable coating actually went through the release coating and into the fabric; the release coating still functioned.
4. The surface meltable (print) coating became loose while processing through the printer, as the coating had a tendency to adhere to the wax ribbon.
5. The paper was difficult to remove after ironing; this was not the case with the efficient, rapid, heating of the heating press.
6. Print was somewhat grainy.
7. Comparative example.

EXAMPLE 5

Testing of Heat Transfer Materials Having a Laser Color Copier Printed Image Thereon The heat transfer materials described in Table 2 above were transferred to substrates and tested using the heat transfer procedure and testing procedure as outlined in Example 4. The testing results are shown below in Table 5.

TABLE 5

Laser Copier Test Results

| Sample | Fabric | Transfer Method | Paper Removal | Color Wash Retention | "Hand" | Tackiness | Other |
|---|---|---|---|---|---|---|---|
| CLC1 | Cotton | Press | Cold | 2 | 5 | 5 | 1 |
| CLC2 | Cotton | Press | Cold | 3 | 5 | 5 | 1 |
| CLC3 | Cotton | Press | Cold | 4 | 5 | 5 | 1 |
| CLC4 | Cotton/Poly | Press | Cold | 4 | 4 | 5 | — |
| CLC5 | Cotton/Poly | Press | Cold | 5 | 4 | 5 | — |

TABLE 5-continued

Laser Copier Test Results

| Sample | Fabric | Transfer Method | Paper Removal | Color Wash Retention | "Hand" | Tackiness | Other |
|---|---|---|---|---|---|---|---|
| CLC5 | Cotton/Poly | Iron | Cold | 5 | 4 | 5 | — |
| CLC5 | Cotton/Poly | Press | Hot | 5 | 5 | 5 | — |
| CLC6 | Cotton/Poly | Press | Cold | 4 | 4 | 5 | — |
| CLC7 | Cotton/Poly | Press | Hot | 5 | 5 | 5 | — |
| CLC8 | Cotton/Poly | Press | Hot | 4 | 3 | 2 | 2 |
| CLC9 | Cotton/Poly | Press | Hot | 3 | 3 | 4 | 2 |

Other key:
1. The surface meltable (print) coating had some voids due to the water repellancy of the release coating.
2. Comparative sample.

EXAMPLE 6

Testing of Heat Transfer Materials Having an Ink Jet Printed Image Thereon

The heat transfer materials described in Table 3 above were transferred to substrates and tested using the heat transfer procedure and testing procedure as outlined in Example 4. The testing results are shown below in Table 6.

TABLE 6

Ink Jet Printable Test Results

| Sample | Fabric | Transfer Method | Paper Removal | Color Wash Retention | "Hand" | Tackiness | Other |
|---|---|---|---|---|---|---|---|
| IJ1 | Cotton | Press | Cold | 4 | 5 | 5 | 1, 2 |
| IJ2 | Cotton | Press | Cold | 4 | 5 | 5 | 1, 2, 3 |
| IJ3 | Cotton | Press | Cold | 4 | 5 | 5 | 1, 2 |
| IJ4 | Cotton | Press | Cold | 4 | 5 | 5 | 1, 2 |
| IJ5 | Cotton | Press | Cold | 4 | 5 | 5 | 1, 2 |
| IJ6 | Cotton/Poly | Iron | Cold | 4 | 3 | 3 | 1, 4 |
| IJ7 | Cotton/Poly | Iron | Cold | 4 | 4 | 5 | 1, 4 |
| IJ7 | Cotton/Poly | Press | Cold | 5 | 4 | 5 | 1 |
| IJ7 | Cotton/Poly | Press | Cold | 5 | 4 | 5 | 5 |
| IJ7 | Cotton/Poly | Press | Cold | 4 | 4 | 5 | 6 |
| IJ8 | Cotton/Poly | Iron | Cold | 5 | 4 | 5 | 1, 3 |
| IJ9 | Cotton/Poly | Iron | Cold | 5 | 4 | 5 | 1, 3 |
| IJ10 | Cotton/Poly | Iron | Cold | 5 | 4 | 5 | 1 |
| IJ11 | Cotton/Poly | Iron | Cold | 5 | 4 | 5 | 1 |
| IJ11 | Cotton/Poly | Press | Cold | 5 | 5 | 5 | 5 |
| IJ11 | Cotton/Poly | Iron | Cold | 5 | 4 | 5 | 6 |
| IJ12 | Cotton/Poly | Press | Cold | 4 | 4 | 5 | 1 |
| IJ12 | Cotton/Poly | Press | Cold | 4 | 4 | 5 | 5 |
| IJ12 | Cotton/Poly | Press | Cold | 3 | 4 | 5 | 6 |

TABLE 6-continued

Ink Jet Printable Test Results

| Sample | Fabric | Transfer Method | Paper Re-moval | Color Wash Re-tention | "Hand" | Tacki-ness | Other |
|---|---|---|---|---|---|---|---|
| IJ13 | Cotton/ Poly | Press | Cold | 3 | 4 | 5 | 6 |
| IJ14 | Cotton/ Poly | Iron | Cold | 4 | 4 | 5 | 1 |
| IJ15 | Cotton/ Poly | Press | Cold | 4 | 4 | 5 | 1 |
| IJ16 | Cotton/ Poly | Iron | Cold | 4 | 4 | 5 | 1 |
| IJ16 | Cotton/ Poly | Iron | Cold | 4 | 4 | 5 | 5 |
| IJ16 | Cotton/ Poly | Iron | Cold | 3 | 4 | 5 | 6 |
| IJ17 | Cotton/ Poly | Press | Hot | 5 | 5 | 5 | 1 |
| IJ17 | Cotton/ Poly | Iron | Cold | 5 | 4 | 5 | 1 |
| IJ17 | Cotton/ Poly | Iron | Cold | 5 | 4 | 5 | 5 |
| IJ17 | Cotton/ Poly | Iron | Cold | 5 | 4 | 5 | 6 |
| IJ18 | Cotton/ Poly | Iron | Cold | 2 | 5 | 5 | 1, 4 |
| IJ18 | Cotton/ Poly | Press | Cold | 2 | 5 | 5 | 1, 4 |
| IJ19 | Cotton/ Poly | Press | Cold | 4 | 4 | 5 | 1 |
| IJ19 | Cotton/ Poly | Iron | Cold | 4 | 4 | 5 | 1, 4 |
| IJ20 | Cotton/ Poly | Iron | Cold | 4 | 3 | 4 | 1, 4 |
| IJ21 | Cotton/ Poly | Iron | Cold | 3 | 4 | 4 | 1, 4 |
| IJ22 | Cotton/ Poly | Press | Cold | 4 | 4 | 5 | 1 |
| IJ23 | Cotton/ Poly | Press | Cold | 4 | 4 | 5 | 1 |
| IJ24 | Cotton/ Poly | Press | Cold | 4 | 4 | 5 | 1 |
| IJ25 | Cotton/ Poly | Iron | Cold | 5 | 4 | 5 | 1 |
| IJ25 | Cotton/ Poly | Iron | Cold | 5 | 4 | 5 | 5 |
| IJ25 | Cotton/ Poly | Iron | Cold | 5 | 4 | 5 | 5 |
| IJ25 | Cotton/ Poly | Press | Hot | 5 | 5 | 5 | 1 |
| IJ26 | Cotton/ Poly | Press | Cold | 5 | 4 | 5 | 1 |
| IJ27 | Cotton/ Poly | Press | Cold | 5 | 4 | 5 | 1 |
| IJ27 | Cotton/ Poly | Press | Cold | 5 | 4 | 5 | 5 |
| IJ27 | Cotton/ Poly | Press | Cold | 5 | 4 | 5 | 6 |
| IJ28 | Cotton/ Poly | Press | Cold | 5 | 4 | 5 | 1 |
| IJ28 | Cotton/ Poly | Press | Cold | 5 | 4 | 5 | 5 |
| IJ28 | Cotton/ Poly | Press | Cold | 5 | 4 | 5 | 6 |
| IJ29 | Cotton/ Poly | Press | Cold | 5 | 4 | 5 | 1 |
| IJ29 | Cotton/ Poly | Press | Cold | 5 | 4 | 5 | 5 |
| IJ29 | Cotton/ Poly | Press | Cold | 4 | 4 | 5 | 6 |
| IJ29 | Cotton/ Poly | Iron | Cold | 5 | 4 | 5 | 1 |
| IJ30 | Cotton/ Poly | Press | Cold | 5 | 4 | 5 | 1 |
| IJ31 | Cotton/ Poly | Iron | Cold | 4 | 2 | 2 | 6, 7 |

TABLE 6-continued

Ink Jet Printable Test Results

| Sample | Fabric | Transfer Method | Paper Re-moval | Color Wash Re-tention | "Hand" | Tacki-ness | Other |
|---|---|---|---|---|---|---|---|
| IJ31 | Cotton/ Poly | Press | Cold | 4 | 3 | 3 | 6, 7 |
| IJ32 | Cotton/ Poly | Press | Cold | 4 | 3 | 3 | 6, 4 |
| IJ32 | Cotton/ Poly | Iron | Cold | 4 | 3 | 3 | 6, 7 |
| IJ33 | Cotton/ Poly | Press | Hot | 4 | 4 | 3 | 1 |
| IJ33 | Cotton/ Poly | Iron | Hot | 4 | 4 | 3 | 1, 8 |
| IJ33 | Cotton/ Poly | Press | Hot | 4 | 4 | 3 | 5 |
| IJ33 | Cotton/ Poly | Press | Hot | 4 | 4 | 3 | 5 |
| IJ34 | Cotton | Press | Cold | 4 | 4 | 5 | 9 |
| IJ34 | Cotton | Iron | Cold | 4 | 4 | 5 | 9 |
| IJ35 | Cotton | Press | Cold | 3 | 4 | 5 | 9 |
| IJ35 | Cotton | Iron | Cold | 4 | 4 | 5 | 9 |
| IJ35 | Cotton | Press | Cold | 4 | 4 | 5 | 9 |
| IJ36 | Cotton | Press | Cold | 4 | 4 | 5 | 9 |
| IJ37 | Cotton | Press | Cold | 4 | 4 | 5 | 9 |
| IJ38 | Cotton | Press | Cold | 4 | 4 | 5 | 8, 9 |
| IJ39 | Cotton | Press | Cold | 4 | 4 | 5 | 6 |
| IJ39 | Cotton | Iron | Cold | 4 | 4 | 5 | 6 |

Other key:
1. Canon BJ600 Printer
2. There were voids in the sub-coating and/or surface meltable (print) coating due to water repellency of the release coating.
3. Some of the interior meltable coating actually went through the release coating and into the fabric; the release coating still functioned.
4. Slight cracking of the image-bearing coating after 5 washes.
5. Epson Stylus 800 printer
6. Hewlett Packard 694 Printer
7. Moderate to severe cracking of the image-bearing coating after 5 washes.
8. The paper was hard to remove. The image-bearing coating of the fabric stretched and became distorted.
9. Epson Photo Stylus Printer.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A heat transfer material comprising:

a base substrate;

a first layer overlying the base substrate;

a second layer overlying the first layer, wherein the first and second layer are melt-flowable at a transfer temperature, the second layer further being transferable to a receiving substrate at the transfer temperature; and a release layer separating the first and second layers, wherein the release layer has essentially no tack at the transfer temperature.

2. The heat transfer material of claim 1, wherein the base substrate comprises a nonwoven web or a polymeric film.

3. The heat transfer material of claim 1, wherein the base substrate comprises paper.

4. The heat transfer material of claim 1, wherein the first layer comprises an extruded film.

5. The heat transfer material of claim 1, wherein the first layer has a melt flow index of less than about 500 and a softening temperature of less than about 400° F.

6. The heat transfer material of claim, 1, wherein the first layer has a melt flow index of from about 0.5 to about 100, and a softening temperature of from about 150° F. to about 300° F.

7. The heat transfer material of claim 1, wherein the first layer has a melt flow index of from about 2 to about 50, and a softening temperature of from about 200° F. to about 250° F.

8. The heat transfer material of claim 1, wherein the second layer has a melt flow index of more than about 10, and a softening temperature of less than about 350° F.

9. The heat transfer material of claim 1, wherein the second layer has a melt flow index of from about 20 to about 20,000, and a softening temperature of from about 150° F. to about 300° F.

10. The heat transfer material of claim 1, wherein the second layer has a melt flow index of from about 30 to about 10,000, and a softening temperature of from about 200° F. to about 250° F.

11. The heat transfer material of claim 1, further comprising one or more additional layers, wherein the one or more layers comprise a sub-coating layer on a surface of the release layer, a top coating layer on a surface of the second layer, or a combination thereof.

12. The heat transfer material of claim 1, further comprising an image printed on the second layer.

13. The heat transfer material of claim 1, in combination with a fabric.

14. The heat transfer material of claim 13, wherein the second layer has a basis weight of less than about 40 gsm.

15. The heat transfer material of claim 13, wherein the second layer has a basis weight of less than about 30 gsm.

16. The heat transfer material of claim 13, wherein the second layer has a basis weight of less than about 20 gsm.

17. A heat transfer material comprising:

a base substrate;

a first layer overlying the base substrate, wherein the first layer has a melt flow index of less than about 500 and a softening temperature of less than about 400° F.;

a second layer overlying the first layer, wherein the second layer has a melt flow index of more than about 10 and a softening temperature of less than about 350° F., wherein the second layer is transferable to a receiving substrate at the transfer temperature; and a release layer separating the first and second layers, wherein the release layer has essentially no tack at the transfer temperature.

18. The heat transfer material of claim 17, wherein the first layer comprises an extruded film.

19. The heat transfer material of claim 17, wherein the first layer has a melt flow index of from about 0.5 to about 100 and a softening temperature of from about 150° F. to about 300° F., and wherein the second layer has a melt flow index of from about 20 to about 20,000 and a softening temperature of from about 150° F. to about 300° F.

20. The heat transfer material of claim 17, wherein the first layer has a melt flow index of from about 2 to about 50 and a softening temperature of from about 200° F. to about 250° F., and wherein the second layer has a melt flow index of from about 30 to about 10,000 softening temperature of from about 200° F. to about 250° F.

* * * * *